US005997395A

United States Patent [19]

Geib et al.

[11] Patent Number: 5,997,395

[45] Date of Patent: Dec. 7, 1999

[54] HIGH SPEED COIN SORTER HAVING A REDUCED SIZE

[75] Inventors: Joseph J. Geib, Mt. Prospect; Scott D. Casanova, Roselle; Bogdan Kowalczyk, Bloomingdale; Glenn C. Gray, Woodridge; Steven S. Kuhlin, Lake Zurich, all of Ill.

[73] Assignee: Cummins-Allison Corp., Mt. Prospect, Ill.

[21] Appl. No.: 09/040,017

[22] Filed: Mar. 17, 1998

[51] Int. Cl.[6] ..... G07D 3/00; B65H 31/20

[52] U.S. Cl. ..... 453/10; 221/241

[58] Field of Search ..... 453/6, 10; 221/241

[56] References Cited

U.S. PATENT DOCUMENTS

| | | | |
|---|---|---|---|
| 3,559,789 | 2/1971 | Hastie et al. | 194/97 |
| 3,672,481 | 6/1972 | Hastie et al. | 194/101 |

(List continued on next page.)

FOREIGN PATENT DOCUMENTS

| | | | |
|---|---|---|---|
| 0 149 906 | 7/1985 | European Pat. Off. . | |
| 0 301 683 | 2/1989 | European Pat. Off. . | |
| 0061302 | 9/1989 | European Pat. Off. . | |
| 0 702 337 | 3/1996 | European Pat. Off. | G07D 3/12 |
| 2614560 | 10/1977 | Germany . | |
| 3808159 | 3/1988 | Germany . | |
| 650871 | 12/1982 | Switzerland . | |
| 2117953 | 10/1983 | United Kingdom . | |
| 2 128 795 | 5/1984 | United Kingdom . | |
| WO 85/00909 | 2/1985 | WIPO . | |
| WO 91/18371 | 11/1991 | WIPO . | |
| WO 95/23387 | 8/1995 | WIPO . | |

OTHER PUBLICATIONS

Brandt "Coin Sorter/Counter" 95 Series (Published more than one year prior to filing date), 2 pages.
Brandt System 930, Model 755, "Electric Counter/Sorter, Security Stand," (Published more than one year prior to filing date), 1 page.
Brandt Model 920/925 (Published more than one year prior to filing date), 2 pages.
Brandt "High Speed Sorter/Counter" Model 940–6 (Published more than one year prior to filing date), 2 pages.
Brandt "High–Speed Sorter" Model 945 (Publication Date more than one year prior to filing date), 2 pages.
Brandt "Coin Sorter/Counter" Model 952 (Published more than one year prior to filing date), 2 pages.
Brandt "Coin Sorter/Counter" Model 954 (Published more than one year prior to filing date), 2 pages.
Brandt "Coin Sorter/Counter" Model 957 (Published more than one year prior to filing date), 2 pages.
Brandt "Coin Sorter/Counter" Model 958 (Published more than one year prior to filing date), 5 pages.
Brandt "High–Speed Coin Sorter and Counter" Model 960 (Published more than one year prior to filing date), 2 pages.
Brandt "Microsort Coin Sorter and Counter" Model 966 (Published more than one year prior to filing date), 4 pages.
Brandt "Coin Sorter and Counter" Model 970 (Published before Jan. 11, 1995), 2 pages.
Brandt "Coin Sorter/Counter" Model 1205 (Published more than one year prior to filing date), 2 pages.
Brandt "Coin Sorter/Counter" Model 1400 (Published more than one year prior to filing date), 2 pages.
Childers, "Computerized Sorter/Counter" (Published more than one year prior to filing date). 3 pages.

(List continued on next page.)

*Primary Examiner*—Robert P. Olszewski
*Assistant Examiner*—Bryan Jaketic
*Attorney, Agent, or Firm*—Arnold White & Durkee

[57] ABSTRACT

A reduced-size coin sorter for sorting coins of mixed diameters is set forth. The sorter includes a coin-driving member and a coin-guiding member. The lower surface of the coin-guiding member forms a plurality of exit channels for guiding coins of different diameters to different exit stations along the periphery of the coin-guiding member. The coin sorter includes an integral base member which concentrically and circumferentially mounts both the rotatable disc and the sorting head. The unitary base member also provides a mounting structure for the electronics and the motor.

45 Claims, 14 Drawing Sheets

U.S. PATENT DOCUMENTS

| | | | |
|---|---|---|---|
| 3,788,440 | 1/1974 | Propice et al. | 194/99 |
| 3,795,252 | 3/1974 | Black | 133/3 A |
| 3,910,394 | 10/1975 | Fujita | 194/97 |
| 3,921,003 | 11/1975 | Greene | 250/557 |
| 3,978,962 | 9/1976 | Gregory, Jr. | 194/97 |
| 3,980,168 | 9/1976 | Knight et al. | 194/100 |
| 3,998,237 | 12/1976 | Kressin et al. | 133/3 A |
| 4,111,216 | 9/1978 | Brisebarre | 133/3 A |
| 4,172,462 | 10/1979 | Uchida et al. | 453/6 |
| 4,178,502 | 12/1979 | Zimmerman | 235/92 |
| 4,234,072 | 11/1980 | Prumm | 194/100 |
| 4,250,904 | 2/1981 | Lueschen | 133/2 |
| 4,254,857 | 3/1981 | Levasseur et al. | 194/100 |
| 4,275,751 | 6/1981 | Bergman | 133/3 C |
| 4,326,621 | 4/1982 | Davies | 194/100 |
| 4,353,452 | 10/1982 | Shah et al. | 194/100 |
| 4,359,062 | 11/1982 | Uecker et al. | 133/2 |
| 4,383,540 | 5/1983 | De Meyer et al. | 133/3 H |
| 4,407,312 | 10/1983 | Davila et al. | 453/32 |
| 4,416,299 | 11/1983 | Bergman | 133/1 R |
| 4,462,513 | 7/1984 | Dean et al. | 194/100 |
| 4,474,281 | 10/1984 | Ronerts et al. | 194/334 |
| 4,483,431 | 11/1984 | Pratt | 194/97 |
| 4,538,719 | 9/1985 | Gray et al. | 194/100 |
| 4,564,036 | 1/1986 | Ristvedt | 453/10 |
| 4,570,655 | 2/1986 | Raterman | 133/3 |
| 4,579,217 | 4/1986 | Rawicz-Szcerbo | 194/317 |
| 4,586,522 | 5/1986 | Taipale et al. | 133/3 E |
| 4,607,649 | 8/1986 | Taipale et al. | 133/3 C |
| 4,620,559 | 11/1986 | Childers | 194/346 X |
| 4,667,093 | 5/1987 | MacDonald | 250/223 |
| 4,681,128 | 7/1987 | Ristvedt et al. | 453/6 |
| 4,681,204 | 7/1987 | Zimmerman | 194/317 |
| 4,696,385 | 9/1987 | Davies | 194/319 |
| 4,715,223 | 12/1987 | Kaiser et al. | 73/163 |
| 4,731,043 | 3/1988 | Ristvedt et al. | 453/6 |
| 4,746,319 | 5/1988 | Zwieg et al. | 453/32 |
| 4,753,624 | 6/1988 | Adams et al. | 453/10 |
| 4,753,625 | 6/1988 | Okada | 453/32 |
| 4,775,354 | 10/1988 | Rasmussen | 453/10 |
| 4,850,469 | 7/1989 | Hayashi et al. | 194/318 |
| 4,863,414 | 9/1989 | Ristvedt et al. | 453/6 |
| 4,864,320 | 9/1989 | Munson et al. | 343/833 |
| 4,881,918 | 11/1989 | Goh et al. | 453/4 |
| 4,921,463 | 5/1990 | Primdahl | 453/3 |
| 4,963,118 | 10/1990 | Gunn et al. | 453/3 |
| 4,964,495 | 10/1990 | Rasmussen | 194/344 |
| 4,966,570 | 10/1990 | Ristvedt et al. | 453/6 |
| 4,971,187 | 11/1990 | Furuva et al. | 194/318 |
| 4,995,497 | 2/1991 | Kai et al. | 194/318 |
| 5,002,174 | 3/1991 | Yoshihara | 194/317 |
| 5,011,455 | 4/1991 | Rasmussen | 453/10 |
| 5,021,026 | 6/1991 | Goi | 453/40 |
| 5,022,889 | 6/1991 | Ristvedt | 453/6 |
| 5,026,320 | 6/1991 | Rasmussen | 453/6 |
| 5,033,602 | 7/1991 | Saarinen et al. | 194/334 |
| 5,055,086 | 10/1991 | Raterman et al. | 453/10 |
| 5,067,604 | 11/1991 | Metcalf . | |
| 5,090,576 | 2/1992 | Menten | 209/587 |
| 5,104,353 | 4/1992 | Ristvedt et al. | 453/6 |
| 5,106,338 | 4/1992 | Rasmussen | 453/10 |
| 5,123,873 | 6/1992 | Rasmussen | 453/10 |
| 5,141,443 | 8/1992 | Rasmussen et al. | 453/10 |
| 5,145,455 | 9/1992 | Todd | 453/6 |
| 5,163,866 | 11/1992 | Rasmussen | 453/10 |
| 5,163,867 | 11/1992 | Rasmussen | 453/10 |
| 5,194,037 | 3/1993 | Jones | 453/10 |
| 5,195,626 | 3/1993 | LeHong | 194/317 |
| 5,197,919 | 3/1993 | Geib | 453/10 |
| 5,205,780 | 4/1993 | Rasmussen | 453/10 |
| 5,209,696 | 5/1993 | Rasmussen | 453/10 |
| 5,213,190 | 5/1993 | Furneaux et al. | 194/317 |
| 5,230,653 | 7/1993 | Shinozaki et al. | 453/4 |
| 5,277,651 | 1/1994 | Rasmussen | 453/10 |
| 5,286,226 | 2/1994 | Rasmussen | 453/10 |
| 5,297,598 | 3/1994 | Rasmussen | 141/314 |
| 5,299,977 | 4/1994 | Mazur et al. | 453/10 |
| 5,372,542 | 12/1994 | Geib | 453/10 |
| 5,401,211 | 3/1995 | Geib | 453/10 |
| 5,425,669 | 6/1995 | Geib | 453/10 |
| 5,429,550 | 7/1995 | Mazur | 453/10 |
| 5,429,551 | 7/1995 | Uecker et al. | 453/18 |
| 5,443,419 | 8/1995 | Adams et al. | 453/17 |
| 5,453,047 | 9/1995 | Mazur | 453/10 |
| 5,468,182 | 11/1995 | Geib | 453/10 |
| 5,480,348 | 1/1996 | Mazur | 453/10 |
| 5,501,632 | 3/1996 | Adams et al. | 453/3 |
| 5,525,104 | 6/1996 | Adams et al. | 453/10 |
| 5,542,880 | 8/1996 | Geib et al. | 453/10 |

OTHER PUBLICATIONS

Cummins–Allison's CA–750 JetSort® Coin Processor (Published more than one year prior to filing date), 1 page.

Cummins–Allison's "JetSort®", State–of–the–Art Coin Processing Comes of Age, (Published more than one year prior to filing date), 1 page.

Cummins–Allison's JetSort® Coin Sorter/Counter, Item No. 50–152, (Published more than one year prior to filing date), 1 page.

Cummins–Allison's "JetSort®" 3000 Series Options, Bag Adaptors, (Published more than one year prior to filing date), 1 page.

Cummins–Allison's JetSort® High Speed Sorter/Counter, Kits I & J, Operating Instructions, (Published before filing date), 12 pages.

Cummins–Allison's JetSort® High Speed Coin Sorter/Counter 2000 Series, (Published before filing date), 2 pages.

Cummins–Allison's JetSort® High Speed Coin Sorter/Counter 3000 Series, (Published before filing date), 2 pages.

IBM "Multilevel Character Recognition System" (Published more than one year prior to filing date), 4 pages.

DeLaRue Systems, MACH 3, (Published before filing date), 1 page.

DeLaRue Cash Systems, Cash Till Sorter/Counter, (Published before filing date), 2 pages.

DeLaRue Systems, MACH 3, Model 6300 Series, Coin Sorter and Counter, Operator Manual (1997), 18 pages.

"Pulsar" AI–1500, (Published more than one year prior to filing date), 13 pages.

HIGH SPEED COIN SORTER HAVING A REDUCED SIZE

FIELD OF THE INVENTION

The present invention relates generally to coin sorting devices and, more particularly, to a type of coin sorter which uses a coin-driving member and a coin-guiding member for sorting coins of mixed diameters.

BACKGROUND OF THE INVENTION

Coin sorters have been used for a number of years. These machines may be large systems which are placed on the floor in a bank, a casino, or a retail store. Alternatively, these machines may be of a smaller variety that fit on a counter top in one of these facilities. As would be expected, the larger systems process coins at higher rates and have additional features not available on the counter-top machines.

But, even in the smaller machines, one of the problems is that these machines require a fair amount of space which creates problems for the end user. With regard to casinos, if more space can be dedicated to gaming machines (i.e. like a slot machine) rather than a coin sorter, then the casino will attract more customers. In retail stores, if more space is dedicated to the display of goods, then the store will sell more goods. Likewise, to reduce the overhead costs, banks are desiring smaller machines to fit into their smaller offices and lobbies. Accordingly, the industries which commonly use coin sorting machines are demanding smaller coin sorters so that additional profits can be realized.

While the market demands a coin sorter machine with a smaller footprint, the sorting capabilities, especially the sorting rate, of the machines must not be compromised. Thus, a need exists for a high-speed coin sorting machine which has a reduced size.

SUMMARY OF THE INVENTION

It is a primary object of this invention to provide a coin sorter that is reduced in size and operates at high speeds and with a high degree of accuracy.

In accordance with the present invention, the foregoing objective is realized by providing a coin sorter which includes a rotatable disc having a resilient top surface and a stationary sorting head having a lower surface positioned parallel to the upper surface of the disc and spaced slightly therefrom. The lower surface of the sorting head forms a plurality of coin exit channels for sorting and discharging coins of different denominations. The sorting head has a diameter about 8 inches or less, but can still sort up to eight different coins. To achieve the sorting of such a high number of coins in a very small area, the coins are queued along a common radius at a gauging station in the sorting head which has an extremely short length, less than about 2 inches. Consequently, the short gauging region allows for a sorting head with a smaller diameter.

The coin sorter system includes a unitary base member on which the bearing assembly for supporting the rotatable disc is mounted. The unitary base member also includes a recess in which a flange of the stationary sorting head is inserted in such a manner that the sorting head is automatically in concentric alignment with the rotatable disc that is positioned therebelow. The sorting head is secured to the unitary base member by fasteners which can be manually manipulated and which can be used to manually adjust the gap that separates the sorting head from the rotatable disc. The unitary base member also has a recess structure which mates with a corresponding structure on the flange of the rotatable disc guarantee that the sorting head is in the appropriate circumferential position relative to the unitary base member.

Because the unitary base member surrounds the periphery of the sorting head where the sorted coins exit from the sorting head, the unitary base member includes a plurality of integral coin chutes, each of which receives a particular denomination from the corresponding exit channel of the sorting head. The coins are then guided by the chutes to coin bins for each denomination. Alternatively, the coins are guided by the chutes to a coin manifold which distributes coins to a cash till of a standard cash register.

The unitary base member may also mount the motor which drives the rotatable disc and the printed circuit boards which control the operation of the coin sorter. Because the unitary base member serves as a mounting structure for numerous components of the overall system, the overall coin sorting system can be efficiently packaged.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENTS

Figure 1:
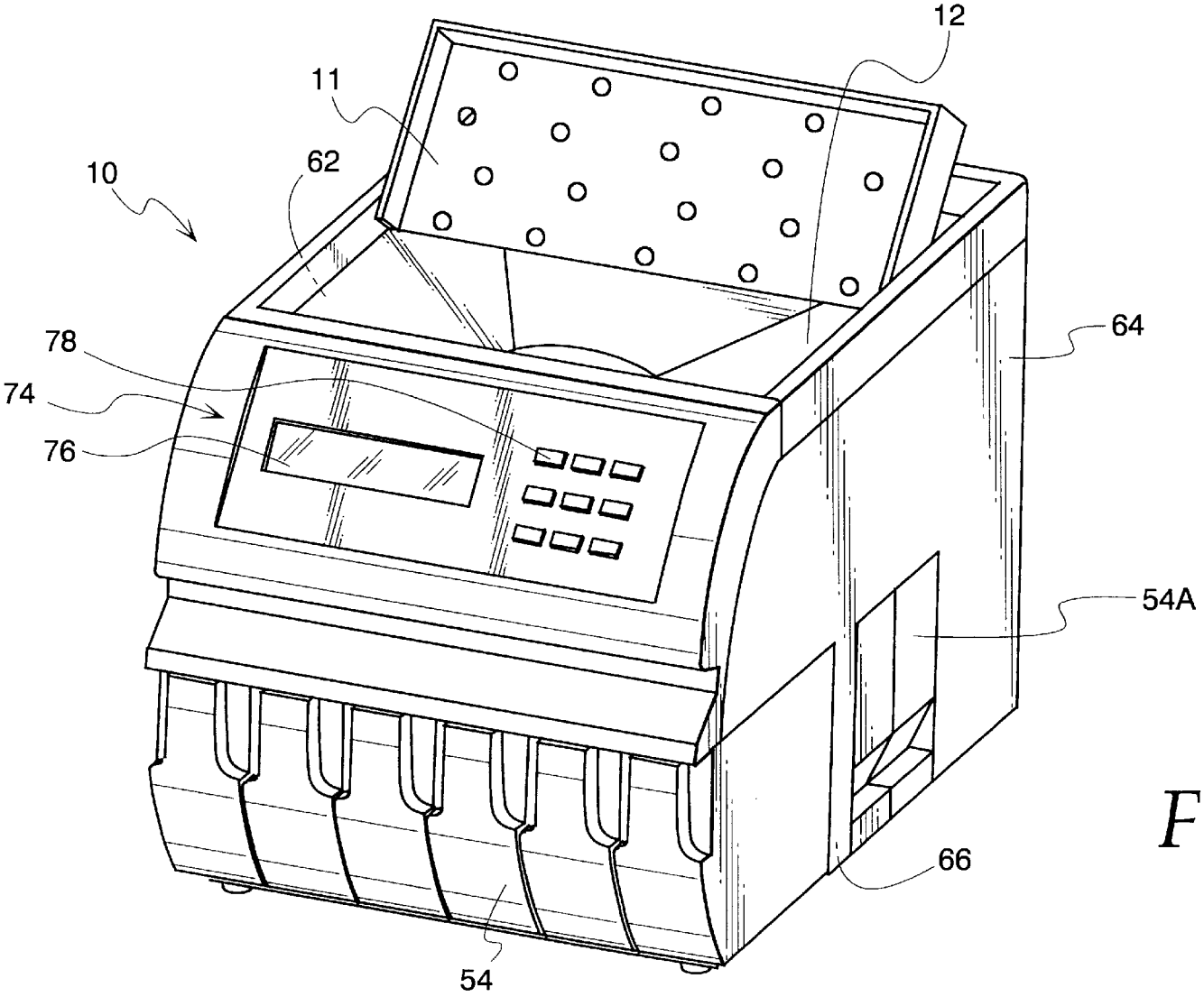
FIG. 1 is perspective view of a coin sorter system embodying the present invention.

Turning now to the drawings and referring first to FIGS. 1–4, a coin sorter system 10 includes a coin tray 12 which receives coins of mixed denominations and feeds them through a central coin hopper 13 into an opening in an annular sorting head 14 positioned below the coin tray 12. The coin tray 12 includes a pivotable section 11 which can be lifted by the operator to urge the coins downwardly towards the opening in the coin tray 12. As the coins pass through the central opening of the sorting head 14, they are deposited on the top surface of a rotatable disc 16. The rotatable disc 16 comprises a resilient pad 18, preferably made of a resilient rubber or polymeric material, bonded to the top surface of a solid disc 20. While the disc 20 is often metal, it can be made of a rigid polymeric material as well.

As the rotatable disc 16 rotates, the coins deposited on the top surface thereof tend to slide outwardly across the surface of the pad 18 of the rotatable disc 16 due to the centrifugal force. As the coins move outwardly, those coins which are lying flat on the pad 18 enter the gap between the upper surface of the pad 18 and the sorting head 14 because the underside of the inner periphery of the sorting head 14 is spaced above the pad 18 by a distance which is approximately as large as the thickness of the thickest coin. As further described below, the coins are sorted into their respective denominations and discharged from exit channels corresponding to their denominations.

The rotatable disc 16 is driven by a belt 22 which is connected to a motor 24. The motor 24 can be an AC or a DC motor. In a preferred embodiment, the motor 24 is a DC motor with the capability of delivering variable revolutions per minute (rpms). The direction of the current through the motor 24 can be changed such that the motor 24 can act upon the rotatable disc 16 to decelerate the disc 16 in addition to accelerating it. In an alternative embodiment, a braking mechanism connected to the motor or to the rotatable disc 16 can assist in decelerating the rotatable disc 16.

A unitary base member 30 is the primary mounting structure for numerous components in the coin sorter system 10. The bearing assembly 32 for rotatably mounting the rotatable disc 16 is located within a recess on the underside of the unitary base member 30. The unitary base member 30 includes an uppermost surface 34 having a circular depression 36 which receives a flange on the periphery of the sorting head 14. Thus, the circular depression 36 allows the sorting head 14 to be concentrically aligned with the rotatable disc 16. The sorting head 14 is secured to the unitary base member 30 with three fastening assemblies 40 positioned around the periphery of the sorting head 14. These three fastening assemblies 40, which can be manipulated by hand, also allow for the adjustment of the spacing between the sorting head 14 and the rotatable disc 16. The fastening assemblies 40 will be described in more detail with respect to FIG. 8.

The unitary base member 30 includes an electronics region 42 into which printed circuit boards 44 are mounted. The printed circuit boards 44 contain the majority of the electrical components that control the operation of the coin sorting system 10. Additionally, the unitary base member 30 includes a motor mount region 46 where the motor 24 is attached.

Because of the need for minimizing the size of the coin sorter system 10, the unitary base member 30 includes a plurality of integral coin chutes 50. The integral coin chutes 50 receive the sorted coins as they exit from the sorting head 14. The number of integral coin chutes 50 is typically the same for each coin sorting system 10; however, the number of coin chutes that are used in a particular coin sorting system 10 will vary depending on the number of coins in the coin set. As can be seen best in FIG. 4, the top of the coin chutes 50 is the uppermost surface 34 of the unitary base member 30.

As will be explained in detail later, the coins are sorted by their diameters within the sorting head 14, exit from the sorting head 14 into a plurality of coin chutes 50, and are captured in a plurality of coin bins 54 positioned on the exterior of the coin sorter system 10. If the coin sorter system 10 is to be used for sorting only six denominations (like in the U.S. coin set), then only the six coin bins 54 located on the front of the coin sorter system 10 are used. Thus, the coin sorter system 10 can fit and operate within a footprint that is defined by length L' and width W in FIG. 2, which will be discussed in more detail below. Alternatively, if the coin sorter system 10 is to be used for sorting eight denominations, then two additional coin bins **54*a* can be placed along the side of the coin sorter system 10**.

The coin bins 54 can be removed entirely from the coin sorter system 10 such that a till from a cash register or coin bags receive the sorted coins. The conversion of the coin sorter system 10 for use with a till of a cash register and for use with coin bags will be discussed with reference to FIGS. 9–11.

To provide a housing for the internal components, the coin sorter system 10 includes several walls. A left wall 62 and a right wall 64 form the sides of the coin sorter system 10. The right side wall 64 includes a cut-out 65 for the insertion of the two side coin bins **54*a*, if these coin bins are 54*a* are needed. The right and left side walls 62 and 64 wrap around the corners to also form a back wall. A floor 66 joins the two side walls 62 and 64 at their bases. An intermediate wall 68 also joins the two side walls 62 and 64 and is provided with a plurality of holes 69 which allow the coins to pass from the coin chutes 50 to the coin bins 54 positioned below the intermediate wall 68. The unitary base member 30 is mounted within the coin sorter system 10 and at least a portion of the unitary base member 30 is positioned over the intermediate wall 68. Below the intermediate wall 68 is a lower front wall 70 that is located between the two side walls 62 and 64. The lower front wall 70 is the surface against which the back of the coin bins 54 are positioned. To close the top of the coin sorter system 10, the coin tray 12 fits between the two side walls 62 and 64**.

An operator control panel 74 is used by the operator to control the coin sorter system 10. The control panel 74 includes a display 76 for displaying information about the coin sorter system 10. The control panel 74 also includes keys 78 allowing the operator to enter information to the coin sorter system 10. The control panel 74 also serves a structural purpose in that it is the surface which closes the upper front portion of the coin sorter system 10. The control panel 74 may also include a touch screen device which provides more versatility to the operator when inputting information to the coin sorter system 10.

To track the angular movement of the rotatable disc 16 under the sorting head 14, the coin sorter system 10 may also include an encoder disc 80 (FIG. 3) that is mounted for rotation on the underside of the rotatable disc 16. The rotation of the encoder disc 80 is monitored by a stationary encoder sensor 79. Because the angular position of the rotatable disc 16 is continuously monitored, the locations of coins which have been sensed by sensors in the sorting head 14 can also be continuously monitored.

Figure 2:
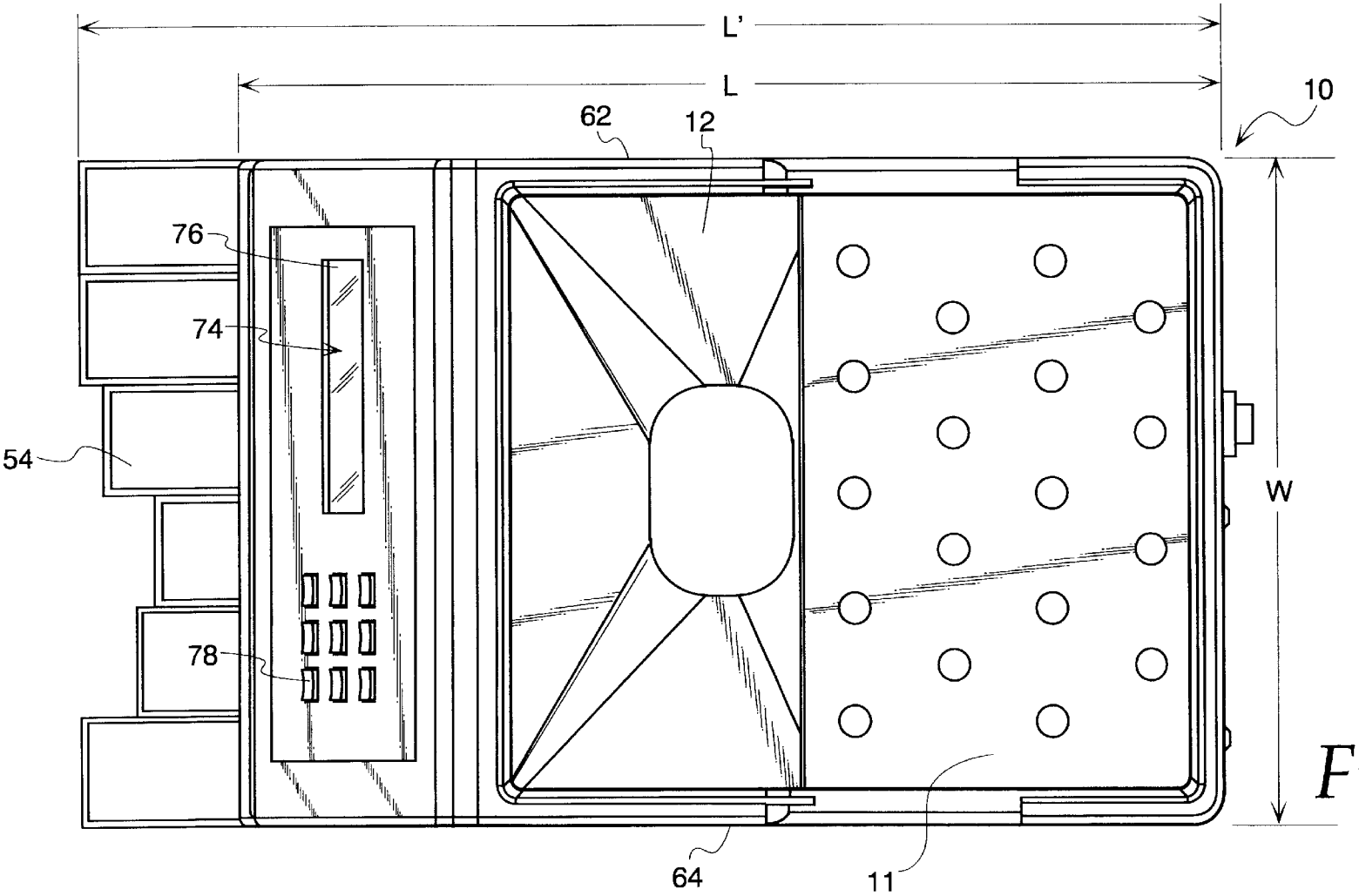
FIG. 2 is top plan view of the coin sorter system of FIG. 1.

The coin sorter system 10 has a length L and a width W as illustrated in the plan view of FIG. 2. In one preferred embodiment using a sorting head 14 with a diameter of about 8 inches, the length L is about 16 inches and the width is approximately 10.5 inches. When the front coin bins 54 are extended, the effective length L' of the coin sorter is about 20 inches. Thus, the coin sorter system 10 has a footprint that is roughly 170 sq. inches when the coin bins 54 are not extended and about 210 sq. inches when the coin bins 54 are extended. The effective footprint (L'×W) is the counterspace that is needed to operate a coin sorter with six coins being sorted (e.g. the U.S. coin set) since opening and closing the coin bins 54 are functions that the operator must perform. The side coin bins 54*a* extend approximately 4 inches outwardly when opened and, therefore, the effective footprint for the coin sorter system 10 when more than six coins are to be sorted is approximately 209 sq. inches (20 inches in length×14.5 inches in width). The height of the coin sorter system 10 is approximately 9 inches.

Figure 5A:
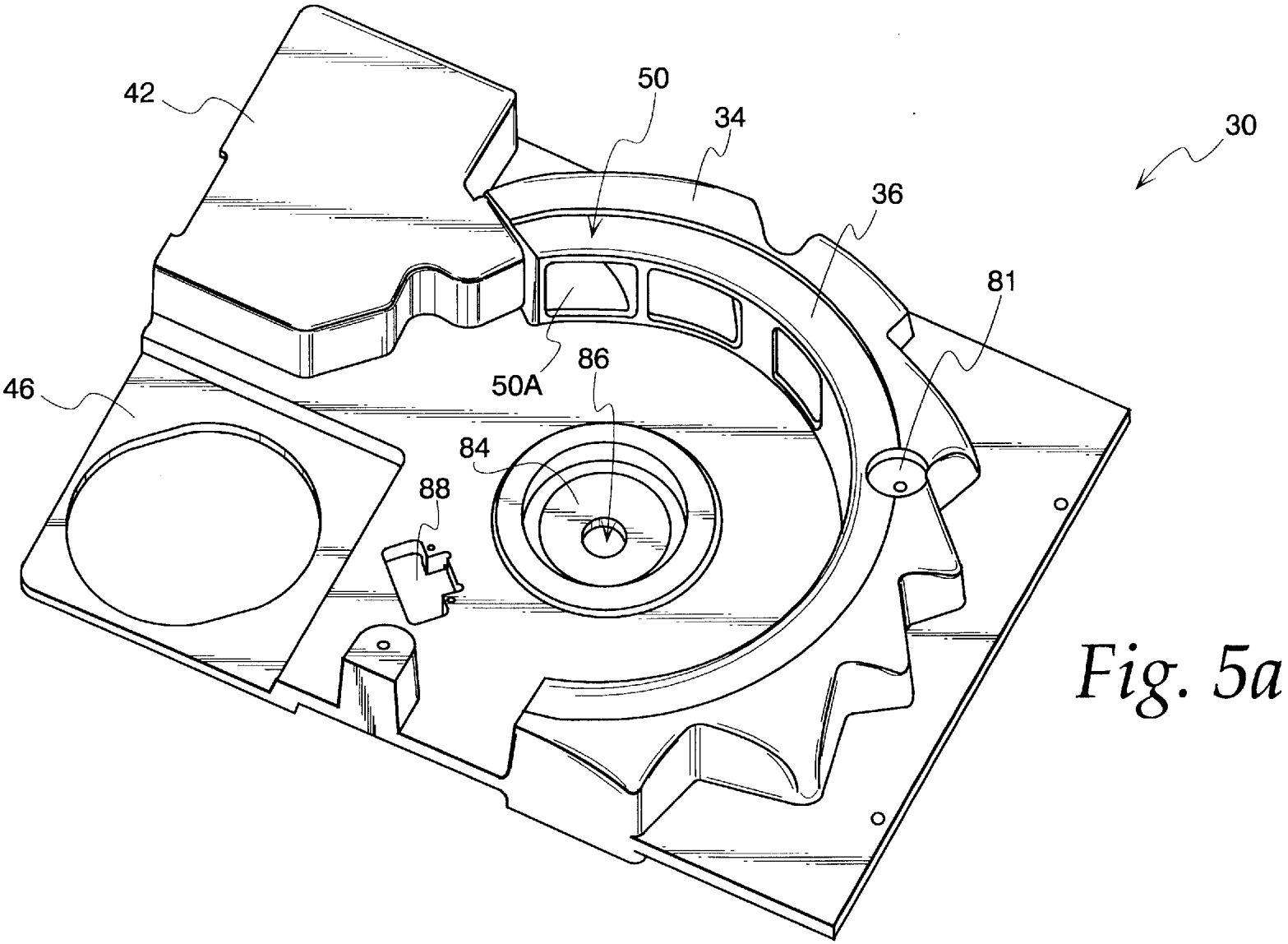
FIGS. 5A and 5B are top and bottom views respectively of the unitary base member in FIG. 4.
Figure 5B:
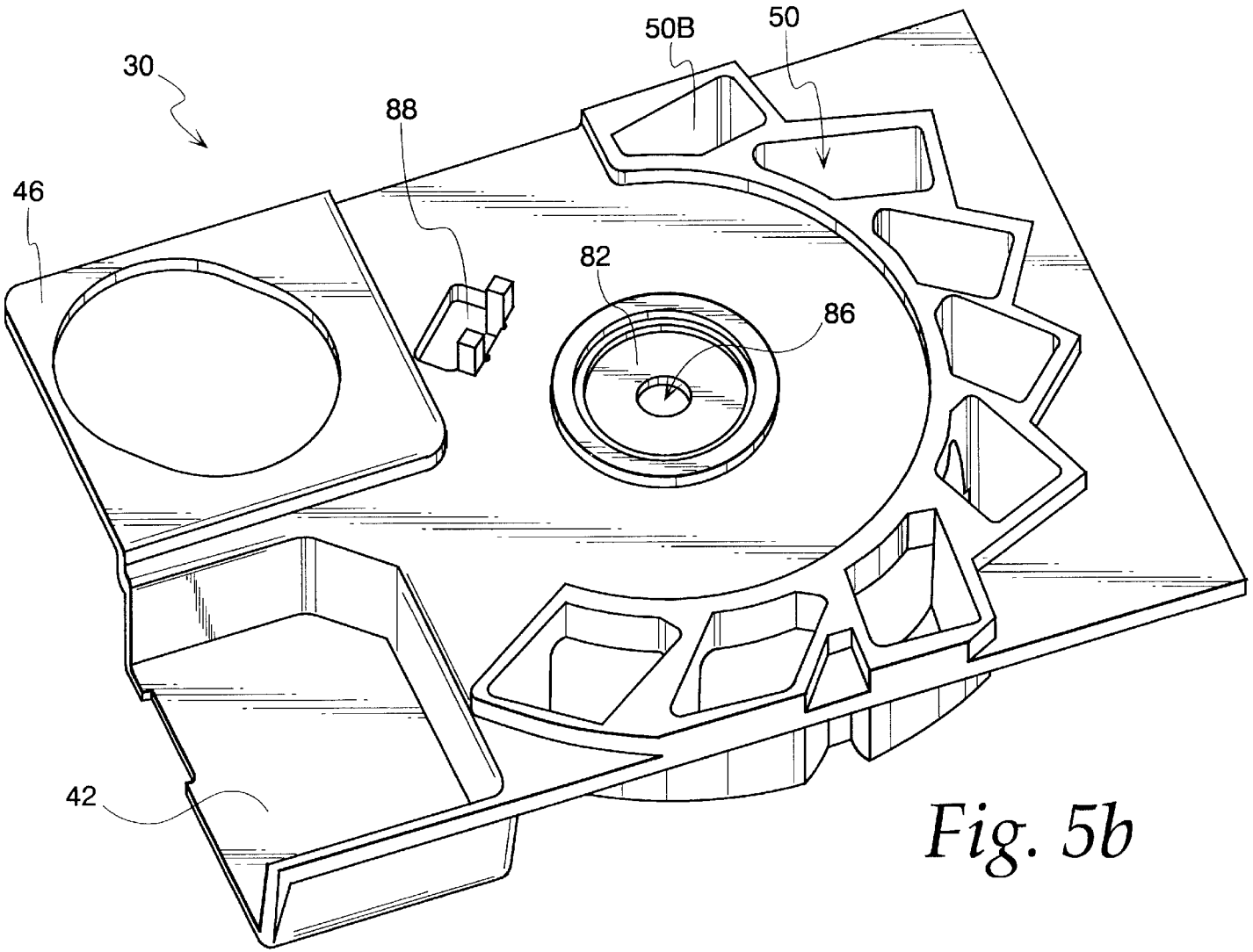

In FIGS. 5A and 5B, the details of the unitary base member 30 can be seen. As stated previously, the unitary base member 30 has several regions for mounting several components, such as the electronics mounting region 42 for the printed circuit boards 44 and the motor mount region 46 for the motor 24. The circular depression 36 in the uppermost surface 34 for registering the sorting head 14 extends more than 180° around the periphery of the sorting head 14. Because the rotatable disc 16 is rotatably fixed to the unitary base member 30, the sorting head 14 is automatically concentrically aligned over the rotatable disc 16 without the need for additional alignment tools as is common in the prior art systems.

Figure 3:
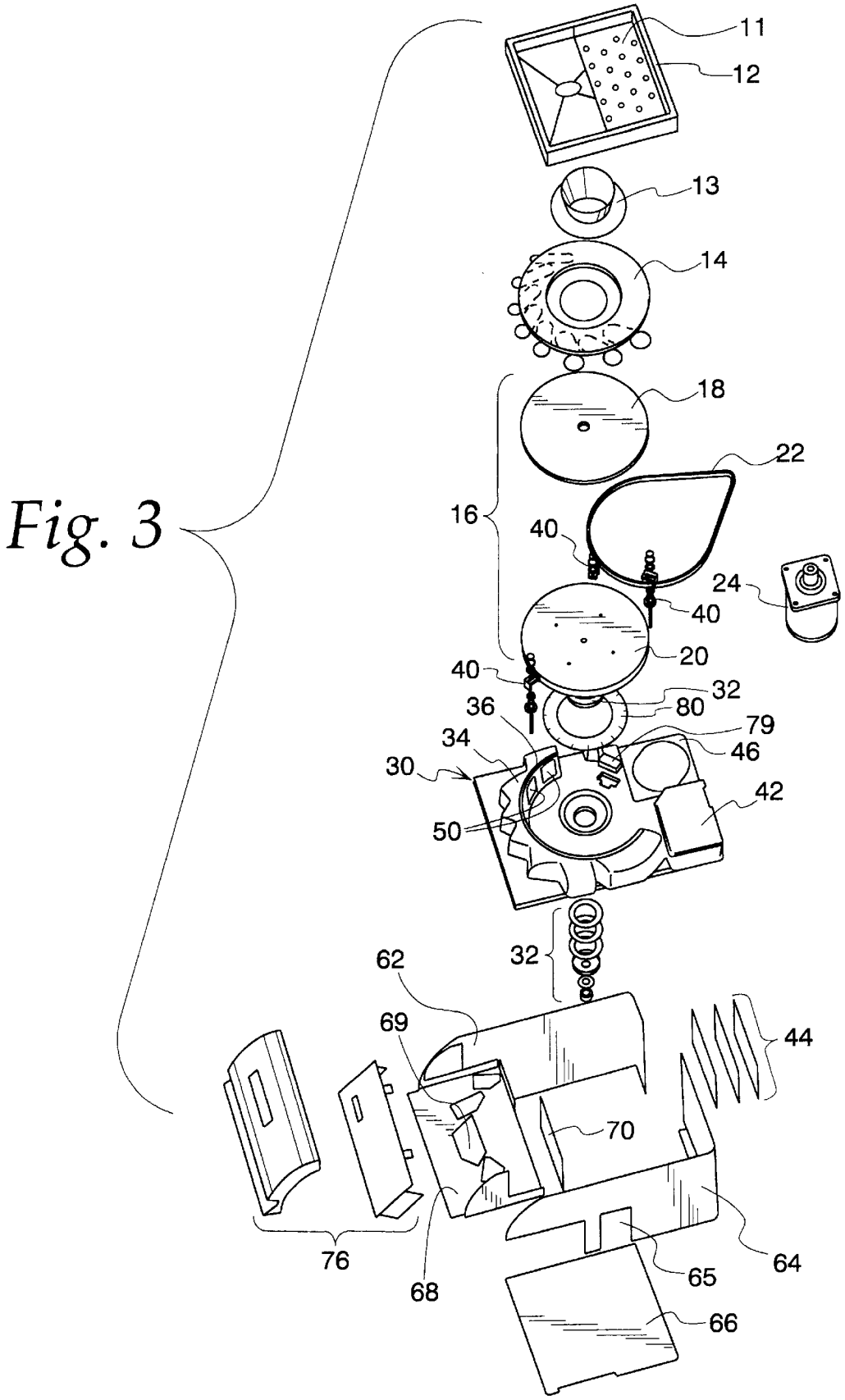
FIG. 3 is an exploded perspective view of primary components of the coin sorter system of FIG. 1.
Figure 4:
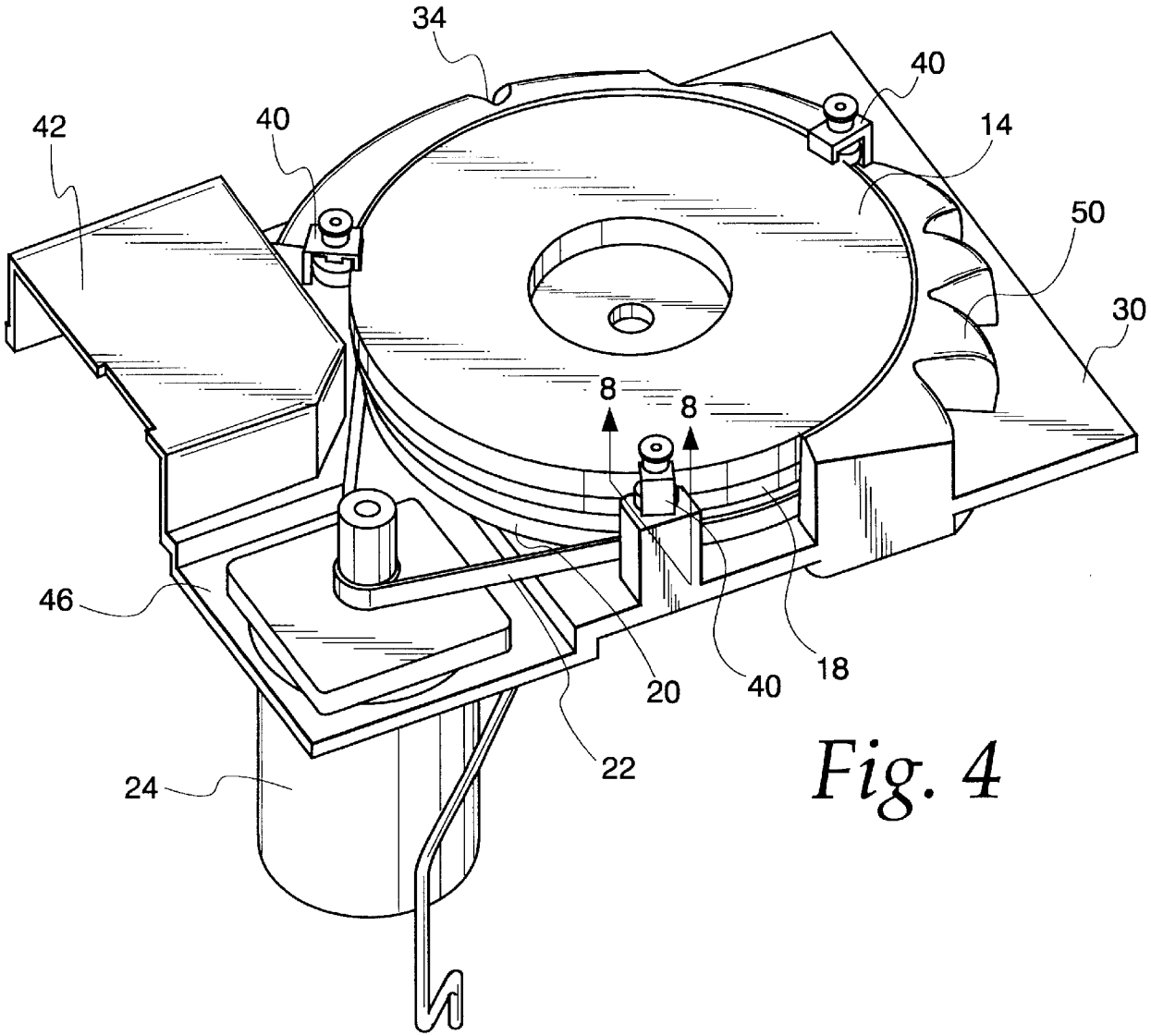
FIG. 4 is a perspective view of the unitary base member, the sorting head and rotatable disc.

The unitary base member 30 can also be thought of as an integral eight-coin coin chute. Each of the eight-coin chutes 50 has an opening 50*a* which is parallel to the axis of rotation of the rotatable disc 16. The opening 50*a* receives the flow of coins as they exit from the periphery of the sorting head 14. On the bottom side of the unitary base member 30, each of the coins chutes 50 has an exit aperture 50*b* through which the sorted coins are guided in a downwardly direction (as seen in FIG. 3). In other words, the coin chutes 50 receive coins in their openings 50*a* having a generally horizontal trajectory and change the direction of the coins such that they leave exit apertures 50*b* with a vertical trajectory.

To move the coins into the coin bins 54 and 54*a*, the two exit apertures 50*b* that are the closest to the electronics mount region 42 are vertically aligned with and dispense coins to the two side coin bins 54*a* (FIG. 1). Each of the remaining six exit apertures 50*b* is vertically aligned over a corresponding one of the front six coin bins 54 and dispenses coins thereto. Also, the plurality of holes 69 on the intermediate wall 68 (FIG. 3) are aligned with the six exit apertures 50*b* that dispense coins to the front six coin bins 54. It should be noted that there does not need to be six holes 69 to accommodate the six bins 54, but simply openings over the six paths leading from the exit apertures 50*b* to the coin bins 54. In other words, there could be one large hole 69 which would accommodate the coin paths for all six denominations.

The uppermost surface 34 of the unitary base member 30 also includes a circumferential registering notch 81 that mates with a corresponding structure on the sorting head 14. This ensures that the sorted coins from the sorting head 14 exit at the locations corresponding to the appropriate coin chute 50.

The bearing components 32 (FIG. 3) are mounted into a first circular recess 82 on the bottom side of the unitary base member 30 and a second circular recess 84 on the top side of the unitary base member 30. The bearing components 32 support the rotatable disc 16 which includes a shaft that is inserted through a central hole 86 in the unitary base member 30. For proper concentric alignment of the rotatable disc 16 and the sorting head 14, the wall on the uppermost surface 34 which defines the circular recess 36 is located on a constant radius with respect to the central hole 86. Consequently, the circular recess 36 of the unitary base member 30 accurately registers the sorting head 14 concentrically over the rotatable disc 16 while the registering notch 81 circumferentially aligns the sorting head 14 with respect to the coin chutes 50.

If the coin sorter system 10 is configured with the encoder sensor 79 and encoder disc 80 (FIG. 3), then the unitary base member 30 has an encoder sensor port 88. The encoder sensor 79 would fit into the port 88 and monitor the movement of the encoder disc 80 as it rotates with the rotatable disc 16.

The unitary base member 30 is preferably made of a polymeric material. Thus, it can be formed through a molding process. If needed the various holes and openings can be machined to result in the final unitary base member 30.

Figure 6A:
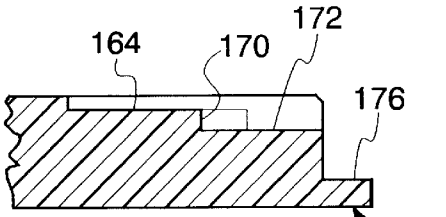
FIG. 6A is a cross-sectional view through one of the exit channels in the sorting head of FIG. 6 taken along line 6A—6A.
Figure 6B:
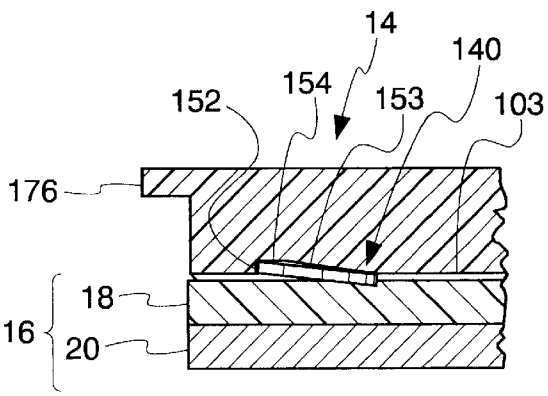
FIG. 6B is a cross-sectional view through the gauging region of the sorting head of FIG. 6 taken along line 6B—6B.
Figure 6:
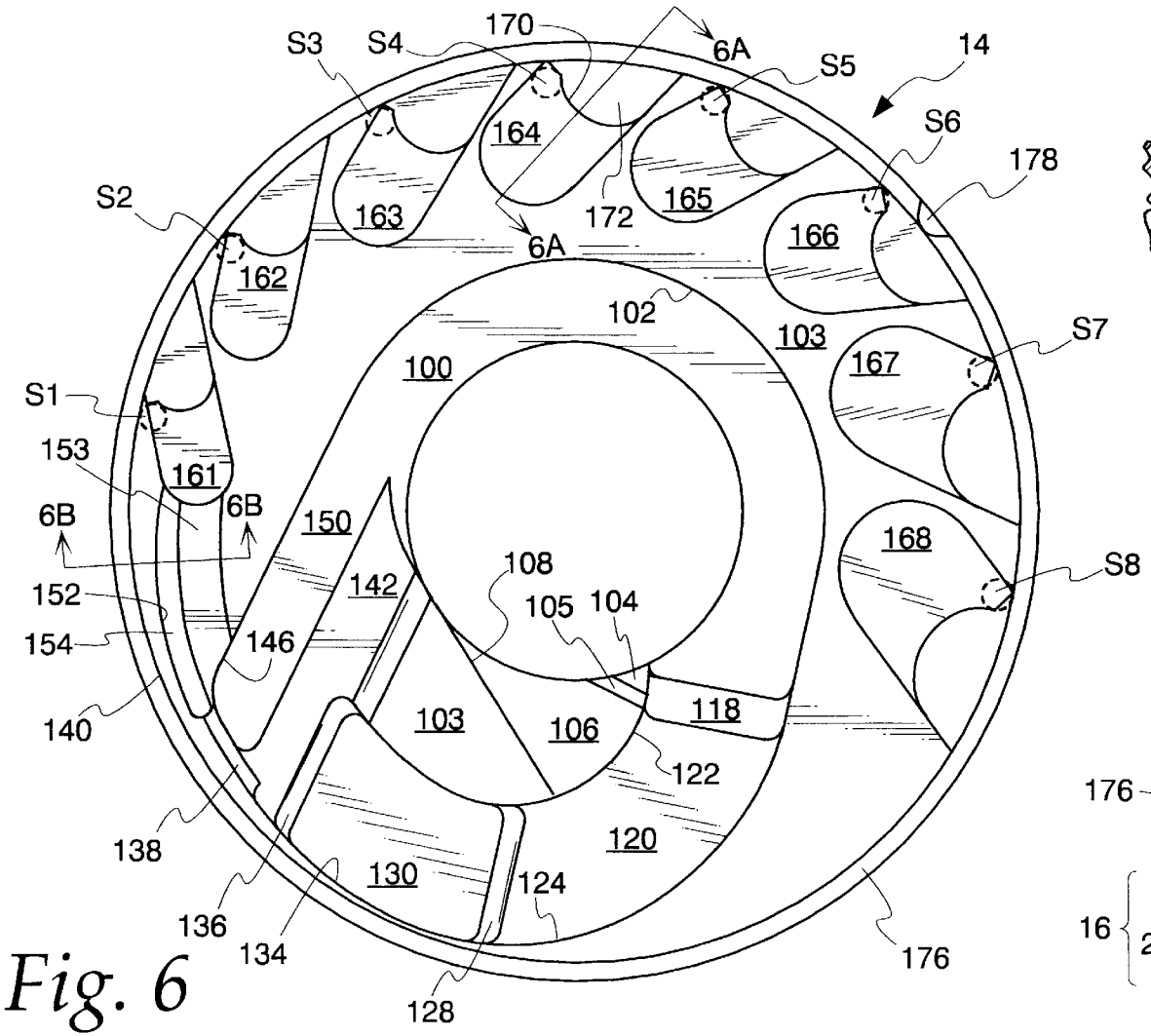
FIG. 6 is a bottom view of the sorting head that is used in the present invention.

Referring now to FIGS. 6, 6A and 6B, the coin sets for any given country are sorted by the sorting head 14 due to variations in their diameters. The coins circulate between the sorting head 14 and the pad 18 on the rotatable disc 16. The coins initially enter an entry channel 100 formed in the underside of the sorting head 14 after being deposited in the coin tray 12. It should be kept in mind that the circulation of the coins is clockwise in FIG. 6, but appears counterclockwise when viewing the coin sorter system 10 since FIG. 6 is a bottom view.

An outer wall 102 of the entry channel 100 divides the entry channel 100 from the lowermost surface 103 of the sorting head 14. The lowermost surface 103 is preferably spaced from the top surface of the pad 18 by a distance which is slightly less than the thickness of the thinnest coins. Consequently, the initial outward movement of all of the coins is terminated when they engage the outer wall 102 of the entry channel 100, although the coins continue to move circumferentially along the wall 102 by the rotational movement imparted on them by the pad 18 of the rotatable disc 16.

In some cases, coins may be stacked on top of each other. Because these stacked coins will be under pad pressure, they may not move radially outward toward wall 102. These stacked coins which are not against wall 102 must be recirculated. To recirculate the coins, the stacked coins encounter a separating wall 104 whereby the upper coin of the stacked coins engages the separating wall 104. The stacked coins are typically to the right (when viewing FIG. 6) of the lead edge of separating wall 104 when the upper coin engages the separating wall 104. While the separating wall 104 prohibits the further circumferential movement of the upper coin, the lower coin continues moving circumferentially across separating wall 104, along ramp 105, and into the region defined by surface 106 where the lower coin is in pressed engagement with the pad 18. Once in a pressed engagement with the pad 18 by surface 106, the recirculated lower coin remains in the same radial position, but moves circumferentially along the surface 106 until engaging recirculating wall 108 where it is directed toward the entry channel 100. The recirculating wall 108 separates surface 106 from a portion of the lower most surface 103. The upper coin of the stacked coins, on the other hand, moves up ramp 118 and into a queuing channel 120.

Those coins which were initially aligned along wall 102 (and the upper coins of stacked coins which engage separating wall 104) move across the ramp 118 leading to the queuing channel 120. The queuing channel 120 is formed by an inside wall 122 and an outside wall 124. The coins that reach the queuing channel 120 continue moving circumferentially and radially outward along the queuing channel 120 due to the rotation of the rotatable disc 16. The radial movement is due to the fact that queuing channel 120 has a height which is greater than the thickest coins so coins are not in engagement with queuing channel 120 and move outwardly on the pad due the centrifugal force of rotation. The outside wall 124 of the queuing channel 120 prohibits the radial movement of the coins beyond the queuing channel 120. The queuing channel 120 cannot be too deep since this would increase the risk of accumulating stacked or "shingled" coins (i.e. coins having only portions which are overlapped) in the queuing channel 120.

In the queuing channel 120, if stacked or "shingled" coins exist, they are under pad pressure and tend to remain in the same radial position. Consequently, as the stacked or "shingled" coins move circumferentially and maintain their radial position, the inside wall 122 engages the upper coin of the "shingled" or stacked coins, tending to separate the coins. The lower coin often engages the surface 106 where it remains under pad pressure causing it to retain its radial position while moving circumferentially with the pad 18. Thus, while the upper coin remains within queuing channel 120, the lower coin passes under the surface 106 for recirculation.

As these coins enter the queuing channel 120, the coins are further permitted to move outwardly and desirably engage the outside wall 124 of the queuing channel 120. The outside wall 124 of the queuing channel 120 blends into the outside wall 102 of the entrance region 100. After the coins enter the queuing channel 120, the coins are desirably in a single-file stream of coins directed against the outside wall 124 of the queuing channel 120.

As the coins move circumferentially along the outside wall 124, the coins engage another ramp 128 which leads to a deep channel 130 where the coins are aligned against the outer wall 134. The outer wall 134 decreases in radius with respect to the central axis of the sorting head 14 when moving in clockwise direction. By decreasing the radius of exterior wall 134, the coins are encouraged to be aligned along the outer wall 134 such that they are in a single file line moving through the deep channel 130 along outer wall 134.

The coins which are aligned along outer wall 134 then move past ramp 136 onto narrow bridge 138. The narrow bridge 138 leads down to the lowermost surface 103 of the sorting head 14. At the downstream end of the narrow bridge 138, the coins are firmly pressed into the pad 18 and are under the positive control of the rotatable disc 16. Therefore, the radial position of the coins is maintained as the coins move circumferentially into a gauging region 140.

If any coin in the stream of coins leading up to the narrow bridge 138 is not sufficiently close to the wall 134 so as to engage the narrow bridge 138, then the misaligned coin moves into surface 142 and engages an outer wall 146 of a reject pocket 150. When the leading edge of the misaligned coin hits wall 146, the misaligned coins are guided back to the entry channel 100 for recirculation via the reject pocket 150.

To summarize, the coins which do not engage narrow ramp 138 can be generally placed into two groups. First, those coins which did not entirely proceed through the queuing channel 120, but instead proceeded past surface 106 back toward the center of the sorting head 14. And, the second group of coins are those coins that missed the narrow ramp 138 and subsequently moved into reject pocket 150.

As shown best in FIG. 6B, the gauging region 140 includes a beveled surface 153 which transitions to a flat surface 154 which leads into a gauging wall 152. The gauging wall 152 decreases in its radial position in the clockwise direction. The coins are actually slightly tilted with respect to the sorting head 14 such that their innermost edges are digging into the pad 18 so as to be under positive pressure of the pad 18. In other words, due to this positive pressure on the innermost edges, the outermost edges of the coins tend to rise slightly away from the pad 18. Because the gauging region 140 applies a greater amount of pressure on the inside edges of the coins, the coins are less likely to bounce off the gauging wall 152 as the radial position of the coins is decreased along the length of the gauging region 140. Thus, the gauging region 140 ensures that the coins are held securely in the proper radial position defined by the gauging wall 152 as the coins approach the series of exit channels 161–168.

The gauging region 140 preferably extends for less than about 40° along the circumference of the sorting head 14. In other words, the arc length of the gauging wall 152 of gauging region is less than about 3 inches. As shown in the preferred embodiment of FIG. 6 where the sorting head 14 is about 8 inches in diameter and sorts eight coins, the gauging region 140 extends for about 30° of the circumference of the sorting head 14 and has a length of about 2 inches. While it was initially thought that the gauging region 140 must extend for a substantial length so that the radius of the gauging wall 152 decreased very gradually to ensure that coins did not bounce off the gauging wall 152, the applicants have found that a gauging region 140 where the radius of the gauging wall 152 decreases over a short length will produce positive results. By providing the gauging region 140 with the profile shown in FIG. 6B, the coins do not bounce off the wall 152 and can quickly be aligned on the radius that is needed for sorting. Consequently, the diameter of an eight-coin sorting head 14 can be made smaller than the sorting heads in previous coin sorter systems. Not only does this shrink the footprint of the coin sorting system 10, but reducing the diameter of the sorting head also decreases the weight of the system.

The first exit channel 161 is dedicated to the smallest coin to be sorted. Beyond the first exit channel 161, the sorting head 14 forms up to seven more exit channels 162–168 which discharge coins of different denominations at different circumferential locations around the periphery of the sorting head 14. Thus, the exit channels 161–168 are spaced circumferentially around the outer periphery of the sorting head 14 with the innermost edges of successive channels located progressively closer to the center of the sorting head 14 so that coins are discharged in the order of increasing diameter.

In the particular embodiment illustrated, the eight exit channels 161–168 are positioned to eject eight successively larger coin denominations which is useful in foreign countries such as Germany and England which have an eight-coin coin set. The sorting head 14 could also be configured to have only six exit channels by eliminating two channels such that the U.S. coin set (dimes, pennies, nickels, quarters, half dollars, and dollar coins) can be sorted. This can also be accomplished by using the sorting head 14 illustrated in FIG. 6 with a blocking element placed in two of the exit channels 161–168.

The innermost edges of the exit channels 161–168 are positioned so that the inner edge of a coin of only one particular denomination can enter each channel. The coins of all other denominations reaching a given exit channel extend inwardly beyond the innermost edge of that particular channel so that those coins cannot enter the channel and, therefore, continue on to the next exit channel under the circumferential movement imparted on them by the pad 18. To maintain a constant radial position of the coins, the pad 18 continues to exert pressure on the coins as they move between successive exit channels 161–168.

Each of the exit channels 161–168 includes a corresponding coin sensor S1–S8. The sensors S1–S8 are used to count the coins as the coins exit from the exit channels 161–168. Thus, when the operator of the coin sorter system 10 places a batch of coins into the coin tray 12 and performs the necessary functions on the operator control panel 74 to begin the sorting process, the coin sorter system 10 has the capability of counting each of the coins in the batch and, thus, determining the monetary value of the batch. The sensors S1–S8 are also included so that the coin sorter system 10 can determine the number of coins that have been placed into a particular coin bin 54 to ensure that a coin bin 54 does not become over-filled. In this situation, the coin sorter system 10 will instruct the operator via the control panel 74 of the potential overfill problem.

The sensors S1–S8 may be discriminator sensors which determine whether the sensed coin is a slug. If the sensors S1–S8 are discriminator sensors, then they have the capability of both counting each coin and verifying the validity of each coin. Also, if the sensors S1–S8 are discriminator sensors, the system controller, discussed in more detail, with reference to FIG. 13, must be able to store validity data, such as magnetic patterns, and compare the detected pattern from each coin to the validity data. If a non-authentic coin is detected, the system may stop immediately and place a message on the control panel 74 which informs the operator of the coin bin 54 that contains the invalid coin. Alternatively, the system may finish the coin batch and provide a summary to the operator at the end of the batch.

Referring now to FIG. 6A, the exit channel 164 is representative of all the exit channels 161–168. Exit channel 164 includes a vertical wall 170 which forms a coin relief 172 adjacent to sensor S4. As seen best in FIG. 6, the profile of the vertical wall 170 is curvilinear. As a coin which is sent through exit channel 164 passes by sensor S4, the front edge of the coin moves past the vertical wall 170. Once the trailing edge of the coin passes by the sensor, it falls into the coin relief 172. Because more of the coin will be outside the periphery of the sorter 14 than what remains within the coin relief 172, gravity will cause the coin to fall from the sorter so that it exits into the appropriate coin bin. If the coin relief 172 was not provided, the coin could remain pinched between the coin sorter 14 and the pad 18. Releasing the sensed coin is important to the coin sorter system 10 when the rotatable disc 16 comes to a stop since the sensed coin has now been counted by the controller and it is assumed that all sensed coins have been released to the coin bins. In summary, the coin relief 172 ensures that any sorted coin that is counted by a sensor ultimately is released into the appropriate coin bin even though the rotatable disc 16 may be stopped.

FIG. 6A also illustrates a flange 176 that extends around the periphery of the sorting head 14. The flange 176 is for mounting the sorting head 14 onto the unitary base member 30. As is shown best in FIG. 5A, the flange 176 of the sorting head 14 fits into the circular recess 36 of the unitary base member 30. The registering structure 178, shown only in FIG. 6, located on the flange 176 fits into the registering notch 81 on the unitary base member 30. Thus, the mating of the male/female connection of the structure 178 and the registering notch 81 guarantees that the sorting head 14 is registered in the proper circumferential position on the unitary base member 30.

Figure 7A:
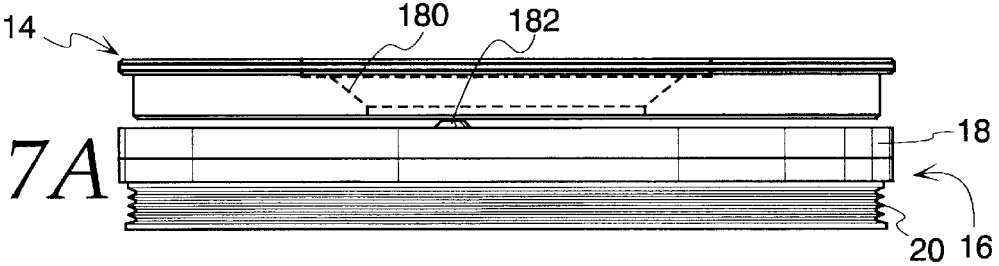
FIG. 7A is a side view of the rotatable disc and the sorting head of the present invention.
Figure 7B:
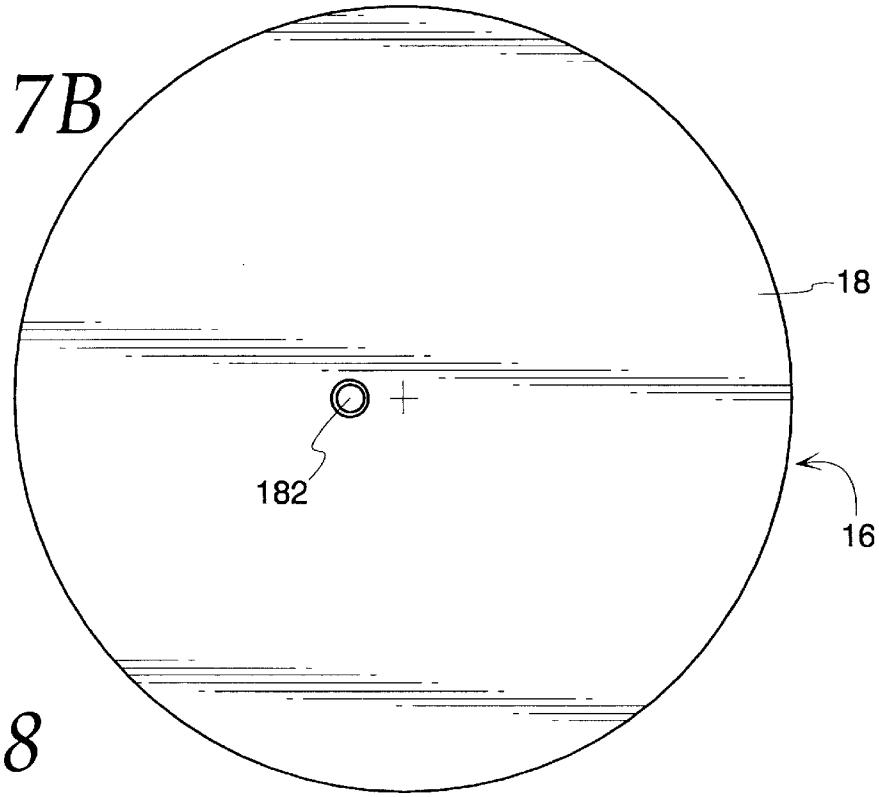
FIG. 7B is a top view of the rotatable disc illustrating the disrupting element for clearing coin jams in the entry area of the sorting head.

Referring now to FIGS. 7A and 7B, the relationship of the sorting head 14 and the rotatable disc 16 is illustrated. The coins from the coin tray 12 pass through an opening 180 in the sorting head 14. After passing through the opening 180, the coins then encounter the resilient pad 18 located on the rigid disc 20. Because the coins are sorted and counted as they move between the pad 18 and the sorting head 14, the function of the entire coin sorter system 10 depends on the relative positioning of the sorting head 14 and the rotatable pad 18. The separation of these two pieces is described in further detail with respect to FIG. 8.

As was stated with respect to FIG. 6, the coins enter the entry channel 100 and move radially outward therefrom. To encourage the coins to move into the entry channel 100, the pad 18 is not entirely planar since it includes a slight disruption 182 below the opening 180 of the sorting head 14. Any coins which become stacked in that region before being moved outwardly under the sorting head 14 into the entry channel 100 are then acted upon by this disrupting element 182 which tends to result in more coins lying flat on the pad 18. The disrupting element 182 is simply a large bump that is present on the pad 18. Thus, it could be a structure that is present on the solid disc 20 such that when the pad 18 is placed over the disc 20, the disrupting element 182 is inherently present on the pad 18. Alternatively, the disrupting element 182 can be a separate structure which is attached to the rotatable disc 16. In summary, the applicants have found that by providing this disrupting element 182, the coins enter the entry channel 100 in a more uniform fashion resulting in higher sorting rates and fewer coin jams.

Figure 8:
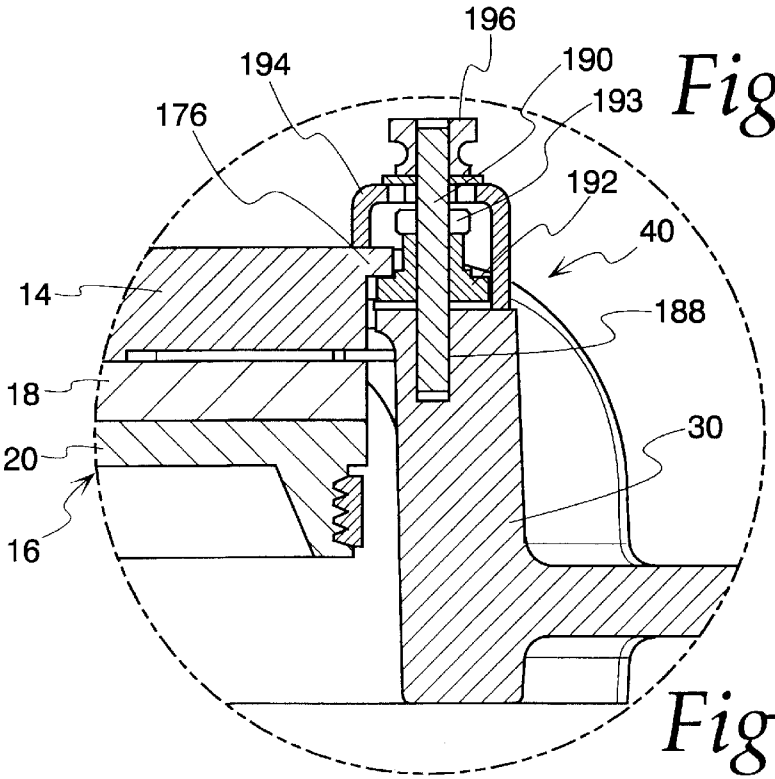
FIG. 8 is a side view of the fasteners which secure the sorting head on the unitary base member above the rotatable disc.

FIG. 8 illustrates the components of the fastening assembly 40 which secure the sorting head 14 on the unitary base member 30. This fastening assembly 40 also allows for the adjustment of the gap between the sorting head 14 and the pad 18. The unitary base member 30 includes a threaded hole 188 into which a threaded rod 190 is inserted. Once the threaded rod 190 is properly secured in the unitary base member 30, a platform 192 is threaded onto the threaded rod 190 to a position which dictates the gap size. A hex-nut 193, which is also threaded on threaded rod 188, rests against the top of the platform 192 and locks the platform 192 in a vertical position along the threaded rod 190. This procedure is done for all three fastening assemblies 40 located on the unitary base member 30. Next, the sorting head 14 is placed into the unitary base member 30 such that the flange 176 of the sorting head 14 engages the surface of the platform 192. Under the force of gravity, the sorting head 14 now is maintained in a particular position above the pad 18. However, by adjusting any of the platforms 192 of the three fastening assemblies 40, the gap between the sorting head 14 and the pad 18 can be adjusted. Once the proper position of the sorting head 14 above the pad 18 is determined, a pinching element 194 is placed over the threaded rod 190. The pinching element 194 has spring-like qualities in that it is resilient under the axial force provided by a wing nut 196 positioned thereabove. When the wing nut 196 is threaded onto the threaded rod 190, the flange 176 of the sorting head 14 is pinched between the pinching element 194 and the platform 192. Accordingly, if another adjustment of the sorting head 14 is necessary, the wing nut 196 is unthreaded from the threaded rod 190, the pinching element 194 is removed from the threaded rod 190, the hex-nut 193 is released, and the platform 192 is adjusted by rotating it around the threaded rod 190 to its new position. Once the new position is attained, the hex-nut 193 is tightened against the platform 192, the pinching element 194 is again placed over the threaded rod 190, and the wing nut 196 is tightened down onto the pinching element 194, thereby securing the sorting head 14 in the appropriate position relative to the pad 18.

By providing a fastening assembly 40 which can be easily manipulated by hand without the need for tools, and a design where the sorting head 14 is automatically concentrically aligned with the rotatable disc 16 and circumferentially aligned relative to the integral coin chutes 50 of the unitary bas member 30, the sorting head 14 can be removed from the coin sorter 10 and replaced with another sorting head 14 in little time, usually less than two minutes. If the sorting head 14 includes sensors S1–S8, the sensors are unplugged from a stationary connector in the coin sorter system 10 when the sorting head 10 is removed. Likewise, the sensors for the new sorting head 10 are plugged into the connector. The modulating of the coin sorter system 10 can be especially helpful when the sorting head 14 is for one type of currency (e.g. U.S. coins) and must be replaced by a sorting head for a second currency (e.g. Canadian coins). In such a situation, the new sorting head 14 is quickly changed for the old sorting head 14 by utilizing the fastening assemblies 40 and the inherent alignment features of the unitary base member 30. The operator of the coin sorter system 10 is then required to instruct the coin sorter system 10 of the new currency that is to be counted by accessing operational options through the control panel 74. The coin sorter system 10 would have the values of the coins of the various currencies stored in its memory so that the values of the foreign currencies can be calculated once the sorting process begins. Alternatively, the coin sorter system 10 may have a PROM for a specific currency which is unplugged and replaced by a PROM for the new currency.

Figure 9:
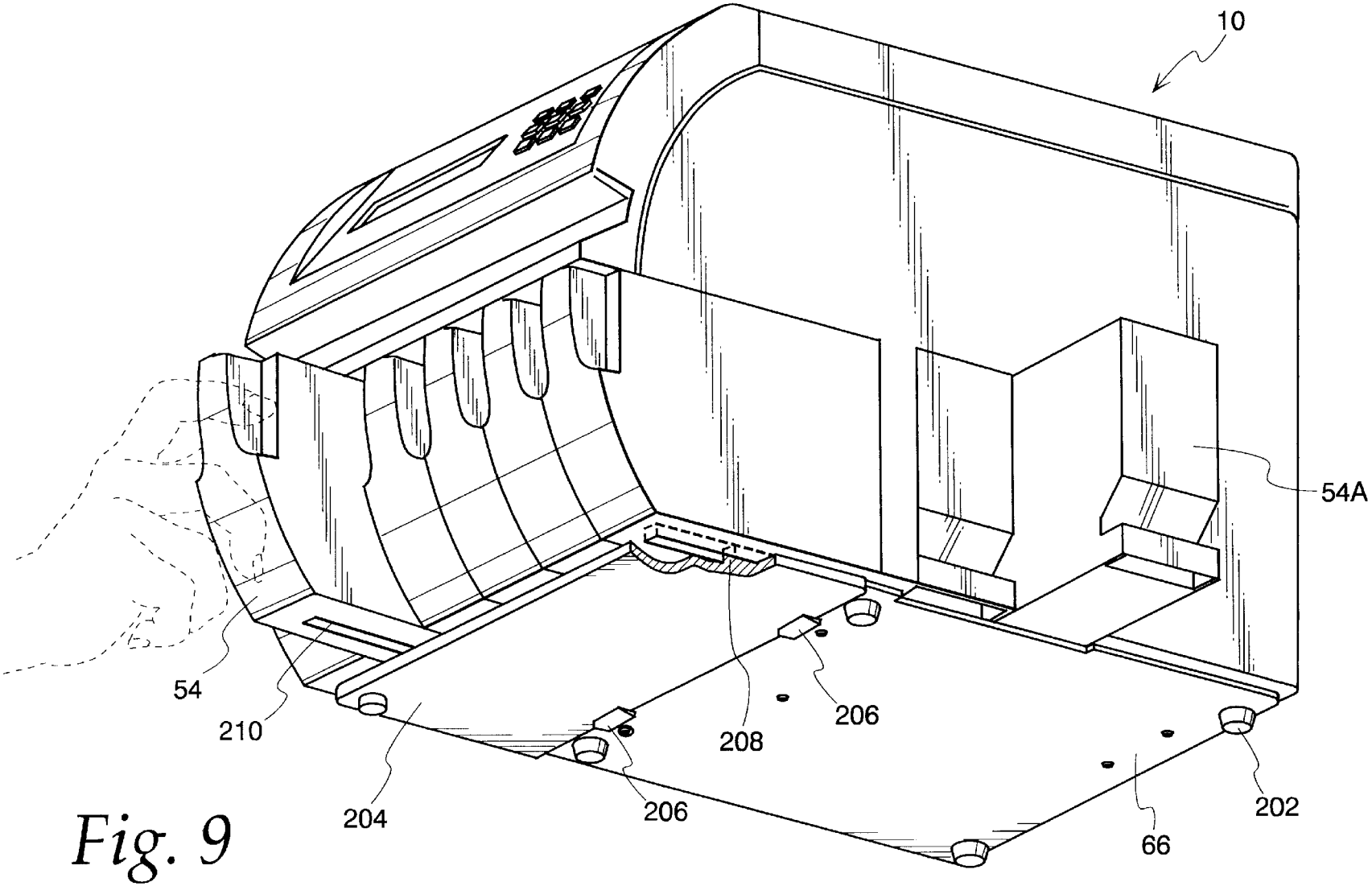
FIG. 9 is a bottom perspective view of the coin sorter system illustrating the attachment of the coin bins.

FIG. 9 illustrates the coin sorter system 10 in an isometric view which illustrates the bottom of the machine. The floor 66 of the coin sorter system 10 includes a plurality of mounts 202 which engage the surface on which the coin sorter system 10 is placed. A coin bin platform 204 is attached to the floor 66 via a plurality of fastening elements 206. Alternatively, the coin bin platform 204 may be integral with the floor 66 such that it is not removable from the floor 66. The coin bin platform 204 includes six parallel projections 208 which engage corresponding slots 210 in the coin bins 54. Accordingly, the operator of the coin sorter system 10 can easily remove one of the coin bins 54 from the coin bin platform 204 and reinsert it. In a similar fashion, the side coin bins 54*a* also may include slots which engage projections on the top side of the floor 66 so that the side coin bins 54*a* can be easily manipulated by the operator of the coin sorter system 10.

However, the operator of the coin sorter system 10 may decide that the coin bins 54 are not needed and, instead, the sorted coins must be directed into the cash till of a typical cash register. Because the coins are sorted based on their diameters, not on their value, it is necessary to distribute the sorted coins into a pattern that coincides with the coin receptacle locations in a cash till of a cash register. In the United States, the typical cash register has coin receptacles in which coins are placed in a manner of increasing value. In fact, most cash tills for cash registers use just one coin receptacle for both the half-dollars and dollars since they are used fairly infrequently. Thus, the standard U.S. cash register has only five coin receptacles.

Figure 10:
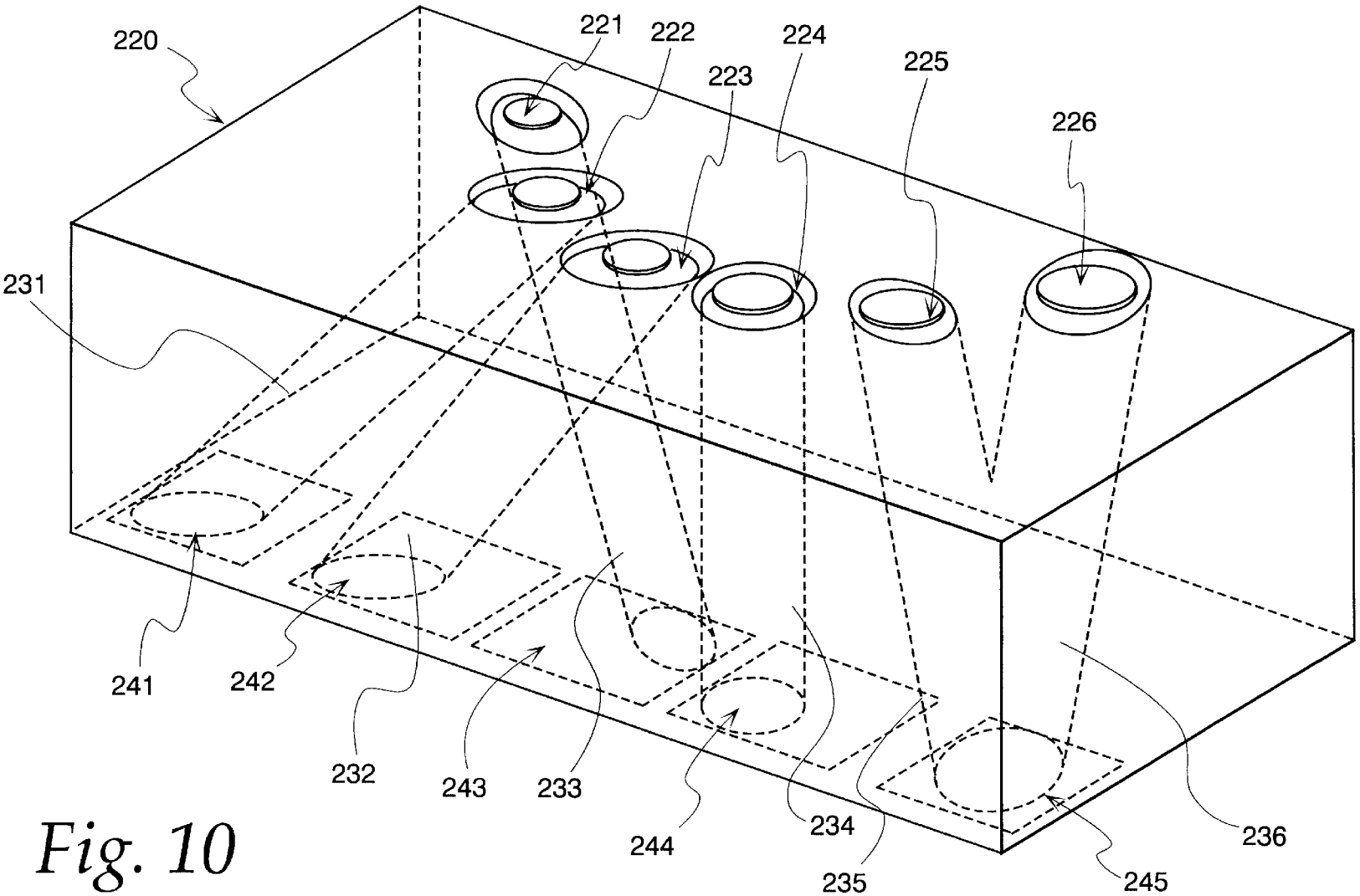
FIG. 10 illustrates a manifold that is used to convert the path of sorted coins so as to be compatible with the till of a standard cash register.

To convert the coin sorter system 10 into a system which places coins into a cash till of a standard retail cash register, the coin sorter system 10 is required to include a manifold 220 as shown in FIG. 10. If the coin bin platform 204 is of the type that requires removal to insert the manifold 220, then the coin bin platform 204 should be removed from the floor 66 of the coin sorter 10 by removing the fastening elements 206. The manifold 220 in FIG. 10 is then fixed to the coin sorter system 10, preferably by hard-manipulating fasteners. If the coin bin platform 204 is of the type that is not removable from the floor 66, the manifold 220 may include a lower structure that allows it to slide into the projections 208.

The manifold 220 includes six inlets 221–226 which receive coins in the order of the diameters of the coins. In other words, when manifold 220 is used with the United States coin set, inlet 221 receives dimes, inlet 222 receives pennies, inlet 223 receives nickels, inlet 224 receives quarter, inlet 225 receives dollars, and inlet 226 receives half-dollars. But to place these coins in ascending value in a coin till, it is necessary to rearrange the flow of these coins along their respective coin paths. Accordingly, from the inlets 221–226, the coins travel down particular coin paths 231–236 which lead only to five outlets 241–245. Consequently, the dimes which enter inlet 221 are transported down path 233 to outlet 243. Pennies enter inlet 222 and pass down path 231 to outlet 241. Nickels enter inlet 223 and pass down path 232 to outlet 242. Quarters enter inlet 224, pass through path 234 and exit through outlet 244. Dollars and half-dollars enter inlets 225 and 226, respectively, pass through paths 235 and 236, respectively, and enter into the same outlet 245.

Figure 11:
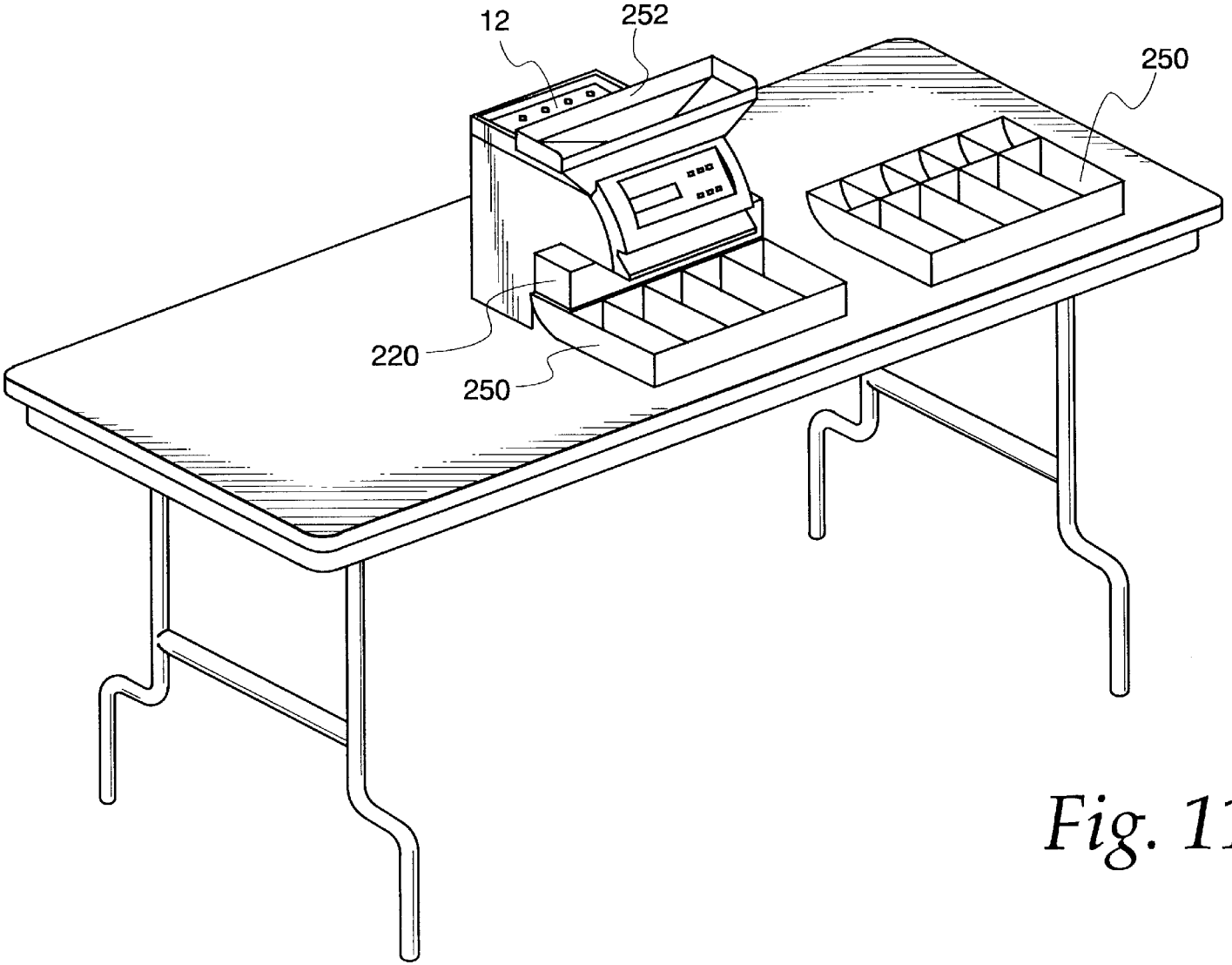
FIG. 11 is a perspective view of the coin sorter system in use with the manifold of FIG. 10 to place sorted coins in the till of a standard cash register.

The coin sorter system 10 may not have enough space below the intermediate wall 68 to accommodate both the manifold 220 and the cash till. Thus, the coin sorter system 10 may be placed on a platform which increases the space underneath the intermediate wall 68. The platform may be configured such that the floor 66 (FIG. 3) is raised in a manner which allows a cash till to be inserted in a reversed direction than what is shown in FIG. 11. This may be beneficial since some countries have coin tills which are arranged with the increasing value of coins going from right to left, not left to right.

As shown in FIG. 11, once the manifold 220 is attached to the coin sorter 210, a cash till 250 can be inserted under the manifold 220. The operator of the system then places the coins that are desired to be distributed into the till 250 into the coin tray 12 of the coin sorter 10. The operator then turns on the coin sorter 10 and the coins are sorted and distributed into the till 250. This results in a very efficient procedure by which retail checkers (e.g. a grocery store checker) inserts the entire day's worth of coins into the coin tray 12, instructs the coin sorter system 10 to begin sorting which returns the coins to the till, and reads the value of the counted coins from the display 76 of the coin sorter 10 to assist him or her in verifying the amounts received in his or her till during the day. This saves the checker from having to count each of the coins present in the till by hand. Likewise, the use of the coin sorter system 10 with the manifold 220 is also helpful at the beginning of the day when a checker takes a given amount of money in currency and coins to the cash register and must determine the initial starting amount present in the cash till 250.

Because the coin sorter system 10 has a width that is less than the typical cash till 250, the coin sorter system 10 may include a conversion device 252 over the coin tray 12. The conversion device 252 is wide enough to allow the checker to insert his or her cash till 250 and dump the coins from till 250 into the coin sorter system 10 for processing without having to worry about the coins being spilled onto the floor. The conversion device 252 essentially funnels the coins into an lower aperture that is about as wide as the coin tray 12.

Figure 11B:
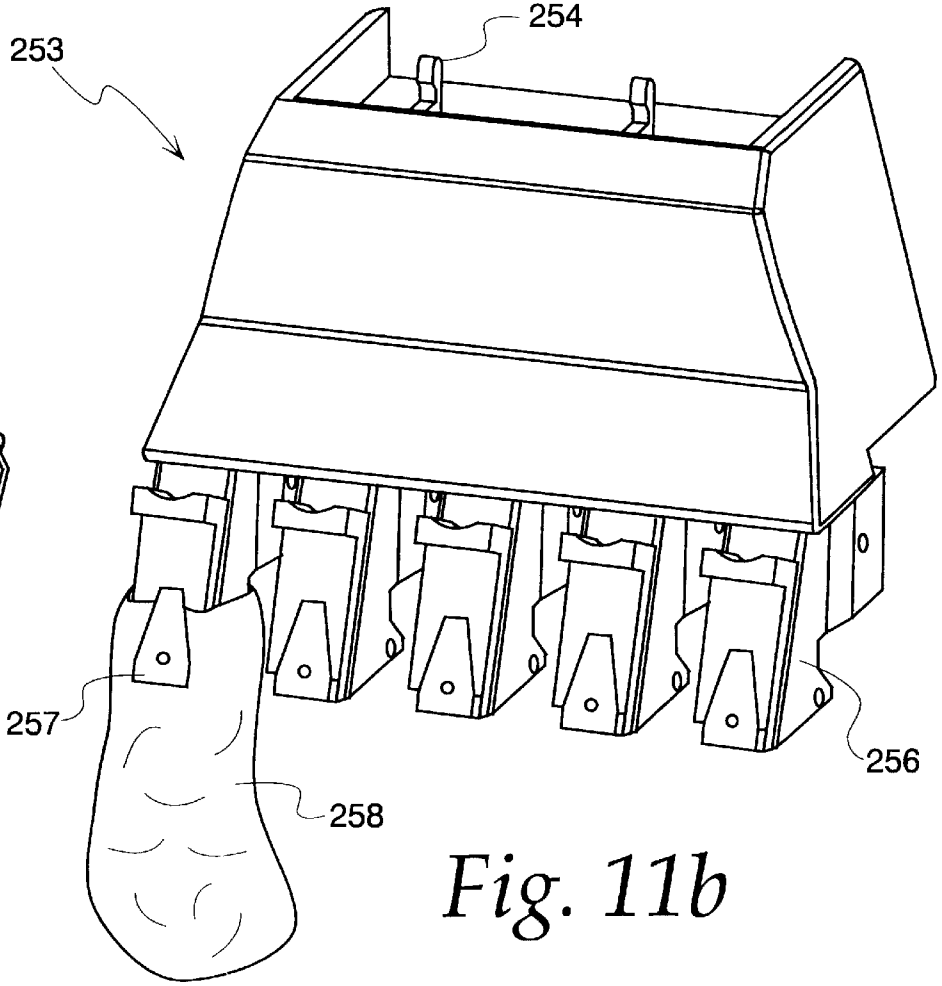
FIGS. 11A and 11B illustrate an alternative manifold which allows for coin bags to be attached to the manifold structure.
Figure 11A:
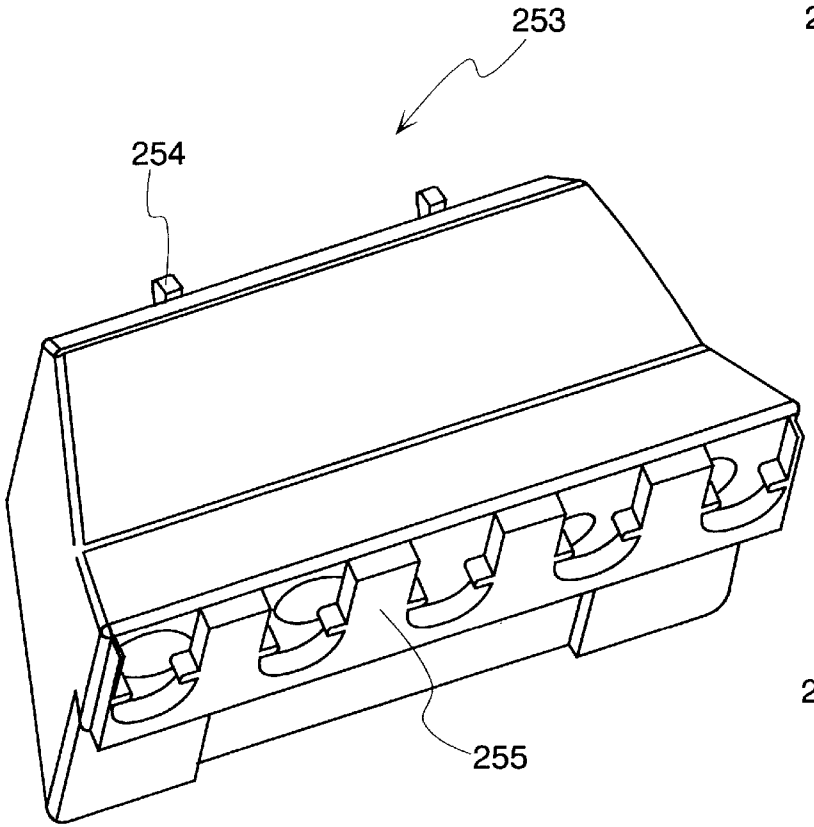

FIGS. 11A and 11B illustrate an alternative embodiment of a manifold 253 which can be used to distribute coins into a cash till 250 as shown in FIG. 11 or can be used to transfer coins into coin bags which are attached to the manifold 253. Adjacent to the coin inlets on the top surface of the manifold 253 are fasteners 254 which secure the manifold 253 to the coin sorter system 10. At the lower end of the manifold 253, a mount section 255 receives bag clamping mechanisms 256. The mount section 255 includes structures which allow the bag clamping mechanisms 256 to be inserted and removed with ease. For example, the mount section 255 may include a groove region which receives a corresponding tongue on the bag clamping mechanism 256. The outlets for the coins are aligned with the bag clamping mechanism 256 when they are attached to the mount section 255. The bag clamping mechanism 256 includes a clip device 257 which holds the bag 258 in the appropriate position.

Because the standard U.S. cash till 250 has only five coin receptacles, the manifold 253 distributes the coins into five bags 257. However, the manifold 253 can be equipped with six inlets and six outlets (as opposed to the six inlets 221–226 and five outlets 241–245 in FIG. 10) to distribute coins into six bags. A diverting mechanism would be placed in the coin paths for the dollar and half-dollar. When the diverter is not in use, the half dollars and dollars would flow into separate outlets. But when the operator actuates the diverting mechanism, the flow of the half dollars would be directed toward the outlet as the dollars. Thus, the operator would dictate when the dollars and half dollars should be separated (e.g. when the bags 258 are in use) or combined (e.g. when the cash till 250 is in use).

In any event, the manifold 253 provides flexibility in the operation of the coin sorter system 10 since the operator can now control whether the coins are to be sent to the cash till 250, the bags 258, or the standard coin bins 54. It should be noted that the coin sorter system 10 must be placed on a platform when the bags 258 are in use since there is only a minimal amount of space under the intermediate wall 68 (FIG. 3). And as mentioned previously, it may be necessary to place the coin sorter system 10 on a platform when the cash till 250 receives the coins since the height of the cash till 250 and the manifold may be more than the space that is available under the intermediate wall 68 (FIG. 3).

Figure 12B:
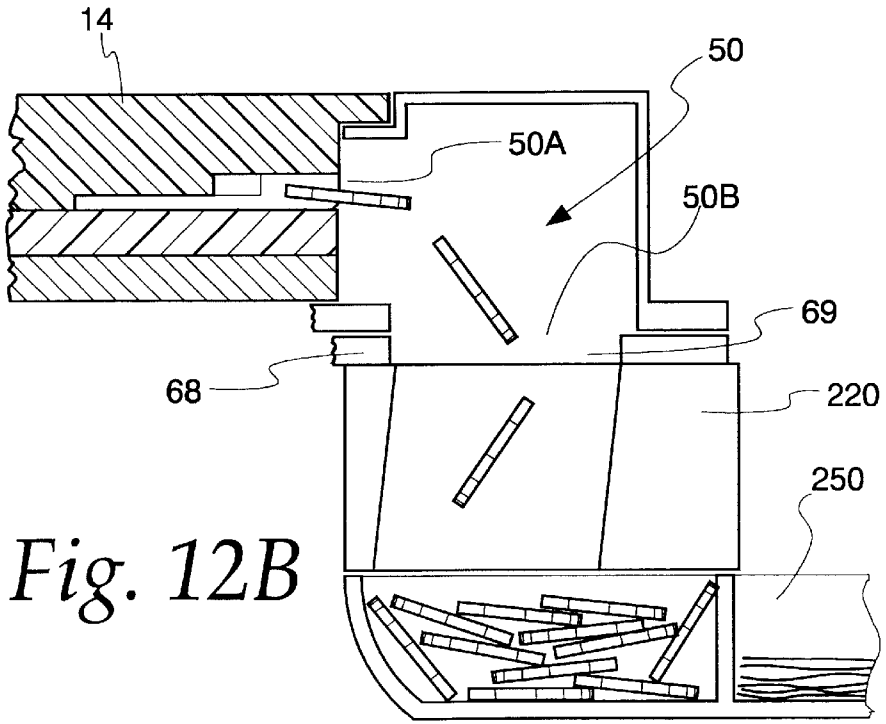
FIGS. 12A–12B illustrate side profiles of the coin paths when the coins are distributed into the coin bins and when the coins are distributed via the manifold of FIG. 10 to the till of a standard cash register.
Figure 12A:
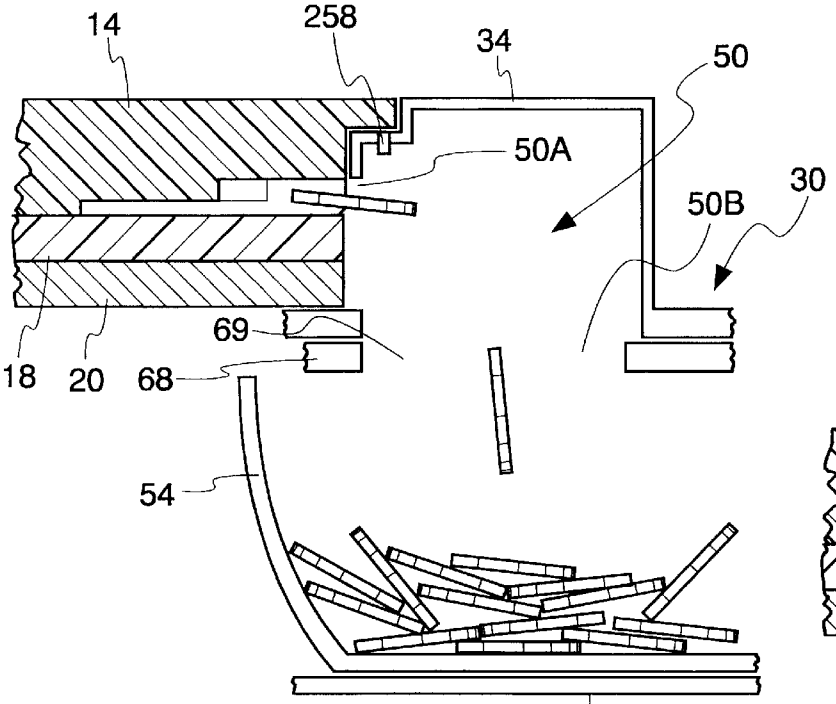

FIGS. 12A and 12B illustrate a side view which compares the coin path of coins as they exit the sorting head 14. In FIG. 12A, the coins exit the sorting head 14 and move into the chute opening 50*a* of the coin chute 50. The coins then move entirely through the coin chute 50 and exit through the exit aperture 50*b* whereupon they pass through the hole 69 in the intermediate wall 68 (see FIG. 3). After moving past the intermediate wall 68, the coins of a particular denomination then encounter the coin bin 54 for that denomination.

FIG. 12A also illustrates an alternative embodiment for sensing the coins. The unitary base member 30 is configured with a coin sensor 258 that is located just outside of the sorting head 14. Thus, as the coins for a particular denomination exit from the sorting head 14, the sensor 258 detects the coin as the coin moves into the coin chute 50. Thus, in this alternative embodiment, the sensors S1–S8 illustrated previously are not needed since the sensors 258 in the unitary base member 30 provide all the sensing that is necessary for the coin sorter system 10. The sensors 258 can also be discriminator sensors such that they not only count the coins, but they also detect characteristics of the coin which allow the controller for the coin sorter system 10 to determine whether a sensed coin is, in fact, an authentic coin.

FIG. 12B illustrates the coin path as the coins exit from the sorting head 14 and are placed into a cash till 250. The coins exit the periphery of the sorting head 14 and rotatable disc 16 and enter the coin chute 50 located in the interior base member 30. The coins pass through the chute opening 50*a* into the coin chute 50 and move through the exit aperture 50*b* before encountering the opening 69 in the intermediate wall 68. Unlike the configuration illustrated in FIG. 12A, the coins then pass through the corresponding coin path in the manifold 220 and enter the corresponding coin bin in the cash till 250. Thus, the only difference between FIGS. 12A and 12B is located below the intermediate wall 68.

Figure 13:
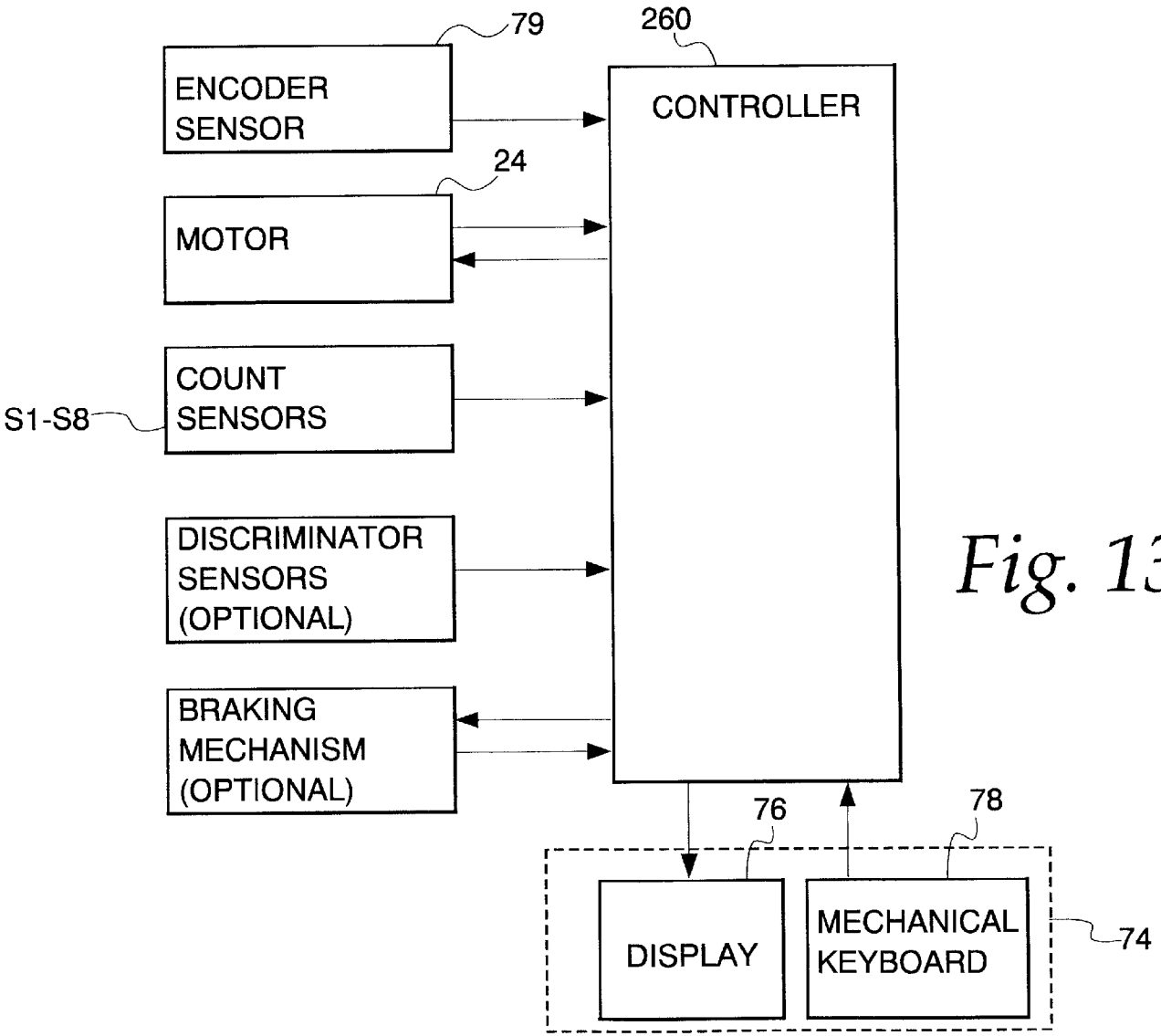
FIG. 13 is a schematic illustrating the operation of the controller and the coin sorter components.

FIG. 13 illustrates a system controller 260 and its relationship to the other components in the coin sorter system 10. The operator communicates with the coin sorter via the operator interface panel 74 by allowing the operator to input information through the mechanical keyboard 78. The display 76 of the operator interface panel 74 informs the operator about the functions and operation of the coin sorter system 10.

The controller 260 receives signals from the encoder sensor 79 which monitors the movement of the encoder disc 80. The encoder disc 80 has numerous uniformly spaced indicia spaced along its circular periphery which the encoder sensor 79 detects. The indicia can be optical or magnetic with the design of the encoder sensor 79 being dependent on which type of indicia is utilized.

Because the encoder disc 80 is fixed to the disc 16, it rotates at the same rate as the disc 16. As the encoder disc 80 rotates, the indicia are detected by the encoder sensor 79 and the angular velocity at which the disc 16 is rotating is known by the controller 260. And, the change in angular velocity, that is the acceleration and deceleration, can be monitored by the controller 260 as well.

Furthermore, the encoder system can be of a type commonly known as a dual channel encoder in which two encoder sensors are used. The signals which are produced by the two encoder sensors and detected by the controller 260 are generally out of phase. The direction of movement of the disc 16 can be monitored by utilizing the dual channel encoder.

The controller 260 also controls the power supplied to the motor 24 which drives the rotatable disc 16. And, because it is often necessary to know whether the motor 24 is operational, the controller 260 detects whether power is being supplied to the motor 24. Typically, this is accomplished by a current sensor which senses the amount of current being supplied to the motor. When the motor 24 is a DC motor, the controller 260 can reverse the current to the motor 24 to cause the rotatable disc 16 to decelerate. Thus, the coin sorter system 10 can control the speed of the rotatable disc 16 without the need for a braking mechanism.

Still in reference to FIG. 13, the controller 260 also monitors the counting sensors S1–S8 which are stationed within the sorting head 14. As coins move past one of these counting sensors S1–S8, the controller 260 receives the signal from the counting sensor for the particular denomination of the passing coin and adds one to the counter for that particular denomination within the controller 260. The controller 260 has a counter for each denomination of coin that is to be sorted. In this way, each denomination of coin being sorted by the coin sorter has a count continuously tallied and updated by the controller 260.

If a braking mechanism is used, the controller 260 also controls the braking mechanism. Because the amount of power applied is proportional to the braking force, the controller 260 has the ability to alter the deceleration of the disc 16 by varying the power applied to the braking mechanism.

Referring again to FIG. 2, the coin sorter system 10 has a sort head 14 of about 8 inches and an operating footprint (L×W) of about 170 sq. inches. When the coin bins 54 are extended, the effective footprint (L'×W) is about 210 sq. inches. This effective footprint is the actual amount of counterspace needed for the coin sorter system 10 since the operator regularly opens and closes the coin bins 54. To sort U.S. coins, only six extra channels are needed. When only U.S. dimes (diameter =0.705 inch) are placed into the system for counting and the rotatable disc is operating at 300 rpms, the dimes are counted at a rate of at least about 2200 coins per minute. When only U.S. quarters (diameter=0.955 inch) are counted, the quarters are counted at a rate of at least about 1000 coins per minute. A common retail mix of coins is about 30% dimes, 28% pennies, 16% nickels, 15% quarters, 7% half-dollars, and 4% dollars. When this retail mix of coins is placed in the coin sorter system 10, the coins are sorted and counted at a rate of at least about 1200 coins per minute. Table 1 summarizes the performance of the coin sorter system 10.

TABLE 1

| ROTATABLE DISC AT 300 RPM | | | |
|---|---|---|---|
| Coin Mix | Minimum Coins Per Minute (CPM) | Minimum CPM Per Operating Area (L × W) | Minimum CPM Per Effective Area (L' × W) |
| Dimes Only | 2200 | 12.9 | 10.5 |
| Quarters Only | 1000 | 5.9 | 4.8 |
| Retail Mix | 1200 | 7.1 | 5.7 |

As would be expected, when the speed of the rotatable disc 16 is increased, the coin sorting rate is proportionally increased. For example, when the rotatable disc 16 operates at 500 rpms and the sorting head 14 is about 8 inches in diameter, the sorting rate increases by about 66%.

TABLE 2

| ROTATABLE DISC AT 500 RPM | | | |
|---|---|---|---|
| Coin Mix | Minimum Coins Per Minute (CPM) | Minimum CPM Per Operating Area (L × W) | Minimum CPM Per Effective Area (L' × W) |
| Dimes Only | 3600 | 21.2 | 17.1 |
| Quarters Only | 1600 | 9.4 | 7.6 |
| Retail Mix | 2000 | 11.8 | 9.5 |

While the invention is susceptible to various modifications and alternative forms, specific embodiment thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

We claim:

1. A coin sorting system for sorting a plurality of coins of mixed denominations, comprising:

a rotatable disc including a resilient upper surface for imparting motion to said coins and a bearing assembly for rotationally mounting said rotatable disc;

a sorting head having a lower surface generally parallel to and spaced slightly from said resilient upper surface of said disc, said lower surface of said sorting head forming a plurality of coin exit channels for sorting and discharging coins of different denominations;

a unitary base structure including means for receiving said bearing assembly so that said rotatable disc is rotationally mounted on said unitary base structure, said unitary base structure further including means for automatically concentrically aligning said sorting head with said rotatable disc; and means for securing said sorting head to said unitary base structure.

2. The coin sorting system of claim 1, wherein said unitary base structure further includes an integral coin chute adjacent to each one of said plurality of coin exit channels for receiving coins that exit from said plurality of coin exit channels.

3. The coin sorting system of claim 2, wherein said unitary base structure further includes means for circumferentially locating said sorting head relative to said integral coin chutes.

4. The coin sorting system of claim 1, wherein said unitary base structure further includes a station for mounting a motor providing rotational movement to said rotatable disc.

5. The coin sorting system of claim 1, wherein said automatic concentric alignment means includes a recess in said unitary base structure, said sorting head including a flange that fits into said recess.

6. The coin sorting system of claim 1, wherein said bearing assembly receiving means includes a first recess in said unitary base structure.

7. The coin sorting system of claim 6, wherein said automatic concentric alignment means includes a second recess in said unitary base structure which receives said sorting head, said second recess and said first recess being defined by walls that are concentric.

8. The coin sorting system of claim 1, wherein said securing means includes fasteners that can be manipulated without the aid of tools.

9. The coin sorting system of claim 1, wherein said unitary base member is made of a polymeric material.

10. The coin sorting system of claim 1, wherein said automatic concentric alignment means effects concentric alignment independent of said securing means.

11. The sorting system of claim 1, wherein said lower surface of said sorting head is located entirely above said rotatable disc in a region defined within a periphery of said rotatable disc.

12. A coin sorting system for sorting a plurality of coins of mixed denominations, comprising:

a rotatable disc including a resilient upper surface for imparting motion to said coins and a bearing assembly for rotationally mounting said rotatable disc;

a sorting head having a lower surface generally parallel to and spaced slightly from said resilient upper surface of said disc, said lower surface of said sorting head forming a plurality of coin exit channels for sorting and discharging coins of different denominations, said sorting head including a flange around at least a portion of a periphery of said sorting head; and a unitary base structure including a first recess for receiving said bearing assembly to rotationally mount said rotatable disc, said unitary base member further including a second recess for receiving said flange of said sorting head to automatically concentrically align said sorting head with said rotatable disc.

13. The coin sorting system of claim 12, wherein said flange extends entirely around said periphery.

14. The coin sorting system of claim 12, wherein said unitary base member further includes means for securing said sorting head to said unitary base member.

15. The coin sorting system of claim 14, wherein said unitary base member further includes means for adjusting a position of sorting head relative to said rotatable disc.

16. The coin sorting system of claim 15, wherein said adjusting means and said securing means are the same device.

17. The coin sorting system of claim 12, wherein said unitary base structure and said sorting head include corresponding male and female structures to provide the proper circumferential alignment of said sorting head relative to said unitary base member.

18. The coin sorting system of claim 17, wherein one of said corresponding male and female structures includes a discontinuous variation in the structures defining said second recess.

19. The coin sorting system of claim 12, wherein said automatic concentric alignment is accomplished without the need for any tools.

20. A coin sorting system for sorting a plurality of coins of mixed denominations, comprising:

a rotatable disc having a resilient upper surface;

a stationary sorting head having a lower surface generally parallel to and spaced slightly away from said resilient upper surface of said disc by a predetermined distance, said lower surface of said sorting head forming a plurality of coin exit channels for sorting and discharging coins of different denominations;

a unitary structure including means for receiving said stationary sorting head so that said sorting head is positioned over said rotatable disc;

means for securing said sorting head to said unitary structure; and means for adjusting said predetermined distance between said rotatable disc and said stationary sorting head, said adjusting means being manipulated by hand without the need for additional tools, said adjusting means effecting the spacing between said rotatable disc and said stationary sorting head adjacent to a periphery of said sorting head and also at a point substantially radially inward of said periphery of said sorting head.

21. The coin sorting system of claim 20, wherein said adjusting means and said securing means are the same structure.

22. The coin sorting system of claim 21, wherein said same structure includes a threaded rod that is coupled to said unitary structure and a platform that is threadably mounted on said rod, said platform supporting said sorting head above said rotatable disc.

23. The coin sorting system of claim 21, wherein said same structure includes a threaded rod that is coupled to said unitary structure and a hand-manipulated nut which secures said sorting head to said unitary structure.

24. The coin sorting system of claim 20, wherein said adjusting means are positioned at three positions around said sorting head.

25. The coin sorting system of claim 20, wherein said securing means can be released without the aid of any tools.

26. The coin sorting system of claim 20, wherein said unitary structure includes a plurality of integral coin chutes for receiving said sorted coins.

27. The coin sorting system of claim 20, wherein said sorting head includes a flange around its periphery, said securing means being in contact with said flange.

28. The coin sorting system of claim 20, wherein said sorting head includes a flange around its periphery, said adjusting means being in contact with said flange.

29. A coin sorting system for sorting a plurality of coins of mixed denominations, comprising:

a rotatable disc imparting motion to said plurality of coins, said rotatable disc being rotatably mounted on a bearing assembly and being driven by a motor;

a stationary sorting head having a lower surface generally parallel to and spaced slightly away from said rotatable disc, said lower surface of said sorting head forming a plurality of coin exit channels for sorting and discharging coins of different denominations;

electronics for operating and controlling said system; and a unitary base structure including means for receiving said stationary sorting head, means for receiving said bearing assembly, means for mounting said motor, and means for mounting said electronics.

30. The coin sorting system of claim 29, wherein said sorting head receiving means and said bearing assembly receiving means are positioned to provide automatic concentric alignment of said rotatable disc and said sorting head.

31. The coin sorting system of claim 29, wherein said unitary base structure further includes fastening elements for adjusting the relative position of said rotatable disc and said sorting head.

32. The coin sorting system of claim 29, wherein said unitary base structure includes a plurality of integral coin chutes for receiving said sorted coins.

33. The coin sorting system of claim 29, wherein said unitary base structure is made of a polymeric material.

34. A coin sorting system for sorting a plurality of coins of mixed denominations, comprising:

means for receiving a plurality of coins;

means for sorting said plurality of coins into a plurality of denominations;

means for discharging said coins at a plurality of exit regions each of which corresponds to one of said plurality of denominations;

a unitary base structure having a plurality of integral coin chutes for receiving said discharged coins and guiding said coins to coin receptacles, each of said plurality of integral coin chutes corresponding to one of said plurality of denominations and being located adjacent to a corresponding one of said plurality of exit regions, said unitary base structure further including means for aligning each of said plurality of exit regions with said corresponding one of said plurality of integral coin chutes; and means for securing said discharging means at a fixed position with respect to said unitary base structure, said securing means being independent of said aligning means.

35. The coin sorting system of claim 34, wherein said unitary base structure is made of a polymeric material.

36. The coin sorting system of claim 34, wherein said plurality of exit regions are generally arranged around a common radius, said plurality of coin chutes including openings arranged around said common radius.

37. The coin sorting system of claim 34, wherein said plurality of coins are from a U.S. coin set with six coins, said plurality of exit regions being six in number.

38. The coin sorting system of claim 34, wherein said alignment means provides circumferential alignment.

39. A coin sorting system for sorting a plurality of coins of mixed denominations, comprising:

a coin moving member for imparting motion to said coins;

a stationary coin guiding member having a lower surface generally parallel to and spaced slightly away from said coin moving member, said coin guiding member having structure which sorts coins for a first currency;

a unitary base structure including means for receiving said stationary coin guiding member so that said coin guiding member is in an operational position relative to said coin moving member;

means for securing said stationary coin guiding member in said operational position relative to said coin moving member; and wherein said stationary coin guiding member is released from said securing means without the aid of any tools and a second sorting head for a second currency is placed over said coin moving member in said operational position and secured to said unitary base member without the aid of any tools.

40. A method for replacing a stationary coin guiding member used for sorting coins in a coin sorting system, said coin guiding member having a lower surface generally parallel to, spaced slightly away from, and concentrically aligned with a coin moving member when said coin guiding member is in an operational position, said method comprising the steps of:

releasing, without the aid of any tools, fasteners which secure said coin guiding member in said operational position;

removing said coin guiding member from said coin sorter system;

providing a second coin guiding member to be used with said coin moving member;

placing said second coin guiding member in said operational position without the aid of any tools; and securing, without the aid of any tools, said second coin guiding member in said operational position with said fasteners.

41. The method of claim 40, wherein said step of placing includes the step of rotating a threadable platform around a threaded rod to adjust the spacing between said second coin guiding member and said coin moving member.

42. The method of claim 40, wherein said second coin guiding member is for different currency than said coin guiding member.

43. The method of claim 40, wherein said step of placing includes the step of inserting said second coin guiding member into a recess on a structure adjacent to said second coin guiding member which limits its lateral position relative to said coin moving member.

44. A coin sorting system for sorting a plurality of coins of mixed denominations, comprising:

a rotatable disc including a resilient upper surface for imparting motion to said coins and a bearing assembly for rotationally mounting said rotatable disc;

a sorting head having a lower surface generally parallel to and spaced slightly from said resilient upper surface of said disc, said lower surface of said sorting head forming a plurality of coin exit channels for sorting and discharging coins of different denominations;

a unitary base structure including a first recess for receiving said bearing assembly so that said rotatable disc is rotationally mounted on said unitary base structure, said unitary base structure further including a second recess for receiving said sorting head, said second recess and said first recess being defined by walls that are concentric; and means for securing said sorting head to said unitary base structure.

45. A coin sorting system for sorting a plurality of coins of mixed denominations, comprising:

a rotatable disc having a resilient upper surface;

a stationary sorting head having a lower surface generally parallel to and spaced slightly away from said resilient upper surface of said disc by a predetermined distance, said lower surface of said sorting head forming a plurality of coin exit channels for sorting and discharging coins of different denominations;

a unitary structure including means for receiving said stationary sorting head so that said sorting head is positioned over said rotatable disc;

a threaded rod attached to said unitary structure and a platform that is threadably mounted on said rod, said platform supporting said sorting head on said unitary structure above said rotatable disc, said platform being adjustable by manual manipulation so as to adjust said predetermined distance between said rotatable disc and said stationary sorting head.

* * * * *